US011462067B2

(12) United States Patent
Atwell et al.

(10) Patent No.: US 11,462,067 B2
(45) **Date of Patent: *Oct. 4, 2022**

(54) IN-VEHICLE TRANSMITTER TRAINING

(71) Applicant: The Chamberlain Group, LLC, Oak Brook, IL (US)

(72) Inventors: Bradley Charles Atwell, North Aurora, IL (US); Garth Wesley Hopkins, Lisle, IL (US); Oddy Khamharn, Lombard, IL (US); Edward James Lukas, Batavia, IL (US); Mark Edward Miller, Middleton, WI (US); Jay Edward Peterson, Westmont, IL (US)

(73) Assignee: The Chamberlain Group LLC, Oak Brook, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/245,672

(22) Filed: Apr. 30, 2021

(65) Prior Publication Data

US 2021/0248852 A1 Aug. 12, 2021

Related U.S. Application Data

(63) Continuation of application No. 16/871,844, filed on May 11, 2020, now Pat. No. 10,997,810.
(Continued)

(51) Int. Cl.
*G07C 9/10* (2020.01)
*G07C 9/00* (2020.01)

(52) U.S. Cl.
CPC ..... *G07C 9/10* (2020.01); *G07C 9/00309* (2013.01)

(58) Field of Classification Search
CPC ..... G07C 9/10; G07C 9/00309
See application file for complete search history.

(56) References Cited

U.S. PATENT DOCUMENTS 29,525 A 8/1860 Sherman
30,957 A 12/1860 Campbell
(Continued)

FOREIGN PATENT DOCUMENTS

AU 645228 2/1992
AU 710682 11/1996
(Continued)

OTHER PUBLICATIONS

US 7,902,994 B2, 03/2011, Geerlings (withdrawn)
(Continued)

*Primary Examiner* — Mohamed Barakat
(74) *Attorney, Agent, or Firm* — Fitch, Even, Tabin & Flannery LLP

(57) ABSTRACT

In an embodiment, an in-vehicle apparatus includes a transmitter operable to transmit radio frequency control signals and communication circuitry configured to communicate with a remote computer via a network. The communication circuitry is configured to receive information from the remote computer via the network, the information pertaining to one or more controllable devices of a user account. The apparatus includes a processor configured to: communicate, via the communication circuitry, a transmitter identifier representative of a transmitter code of the transmitter with the remote computer; effect the movable barrier operator to change a state of a movable barrier by causing the transmitter to transmit a first radio frequency control signal to the movable barrier operator system; and effect the movable barrier operator to learn the transmitter by causing the transmitter to transmit a second radio frequency control signal to the movable barrier operator system.

37 Claims, 8 Drawing Sheets

Related U.S. Application Data

(60) Provisional application No. 62/848,764, filed on May 16, 2019.

(56) References Cited

U.S. PATENT DOCUMENTS

| | | | |
|---|---|---|---|
| 35,364 | A | 5/1862 | Cox |
| 803,047 | A | 10/1905 | Browne |
| 2,405,500 | A | 8/1946 | Gustav |
| 2,963,270 | A | 12/1960 | Magarian |
| 3,716,865 | A | 2/1973 | Willmott |
| 3,735,106 | A | 5/1973 | Hollaway |
| 3,792,446 | A | 2/1974 | McFiggins |
| 3,798,359 | A | 3/1974 | Feistel |
| 3,798,360 | A | 3/1974 | Feistel |
| 3,798,544 | A | 3/1974 | Norman |
| 3,798,605 | A | 3/1974 | Feistel |
| 3,845,277 | A | 10/1974 | Spetz |
| 3,890,601 | A | 6/1975 | Pietrolewicz |
| 3,906,348 | A | 9/1975 | Willmott |
| 3,938,091 | A | 2/1976 | Atalla |
| 4,037,201 | A | 7/1977 | Willmott |
| 4,064,404 | A | 12/1977 | Willmott |
| RE29,525 | E | 1/1978 | Willmott |
| 4,078,152 | A | 3/1978 | Tuckerman |
| 4,097,859 | A | 6/1978 | Looschen |
| 4,138,735 | A | 2/1979 | Allocca |
| 4,178,549 | A | 12/1979 | Ledenbach |
| 4,195,196 | A | 3/1980 | Feistel |
| 4,195,200 | A | 3/1980 | Feistel |
| 4,196,310 | A | 4/1980 | Forman |
| 4,218,738 | A | 8/1980 | Matyas |
| 4,243,976 | A | 1/1981 | Warner |
| 4,255,742 | A | 3/1981 | Gable |
| 4,304,962 | A | 12/1981 | Fracassi |
| 4,305,060 | A | 12/1981 | Apple |
| 4,316,055 | A | 2/1982 | Feistel |
| 4,326,098 | A | 4/1982 | Bouricius |
| 4,327,444 | A | 4/1982 | Court |
| 4,328,414 | A | 5/1982 | Atalla |
| 4,328,540 | A | 5/1982 | Matsuoka |
| RE30,957 | E | 6/1982 | Feistel |
| 4,380,762 | A | 4/1983 | Capasso |
| 4,385,296 | A | 5/1983 | Tsubaki |
| 4,387,455 | A | 6/1983 | Schwartz |
| 4,387,460 | A | 6/1983 | Boutmy |
| 4,393,269 | A | 7/1983 | Konheim |
| 4,418,333 | A | 11/1983 | Schwarzbach |
| 4,426,637 | A | 1/1984 | Apple |
| 4,445,712 | A | 5/1984 | Smagala-Romanoff |
| 4,447,890 | A | 5/1984 | Duwel |
| 4,454,509 | A | 6/1984 | Buennagel |
| 4,464,651 | A | 8/1984 | Duhame |
| 4,468,787 | A | 8/1984 | Keiper |
| 4,471,493 | A | 9/1984 | Schober |
| 4,471,593 | A | 9/1984 | Ragland |
| 4,491,774 | A | 1/1985 | Schmitz |
| 4,509,093 | A | 4/1985 | Stellberger |
| 4,529,980 | A | 7/1985 | Liotine |
| 4,535,333 | A | 8/1985 | Twardowski |
| 4,566,044 | A | 1/1986 | Langdon |
| 4,574,247 | A | 3/1986 | Jacob |
| 4,578,530 | A | 3/1986 | Zeidler |
| 4,580,111 | A | 4/1986 | Swanson |
| 4,581,606 | A | 4/1986 | Mallory |
| 4,590,470 | A | 5/1986 | Koenig |
| 4,593,155 | A | 6/1986 | Hawkins |
| 4,596,898 | A | 6/1986 | Pemmaraju |
| 4,596,985 | A | 6/1986 | Bongard |
| 4,599,489 | A | 7/1986 | Cargile |
| 4,602,357 | A | 7/1986 | Yang |
| 4,611,198 | A | 9/1986 | Levinson |
| 4,623,887 | A | 11/1986 | Welles |
| 4,626,848 | A | 12/1986 | Ehlers |
| 4,628,315 | A | 12/1986 | Douglas |
| 4,630,035 | A | 12/1986 | Stahl |
| 4,633,247 | A | 12/1986 | Hegeler |
| 4,638,433 | A | 1/1987 | Schindler |
| 4,646,080 | A | 2/1987 | Genest |
| 4,652,860 | A | 3/1987 | Weishaupt |
| 4,653,076 | A | 3/1987 | Jerrim |
| 4,670,746 | A | 6/1987 | Taniguchi |
| 4,677,284 | A | 6/1987 | Genest |
| 4,686,529 | A | 8/1987 | Kleefeldt |
| 4,695,839 | A | 9/1987 | Barbu |
| 4,703,359 | A | 10/1987 | Rumbolt |
| 4,710,613 | A | 12/1987 | Shigenaga |
| 4,716,301 | A | 12/1987 | Willmott |
| 4,720,860 | A | 1/1988 | Weiss |
| 4,723,121 | A | 2/1988 | Van |
| 4,731,575 | A | 3/1988 | Sloan |
| 4,737,770 | A | 4/1988 | Brunius |
| 4,740,792 | A | 4/1988 | Sagey |
| 4,750,118 | A | 6/1988 | Heitschel |
| 4,754,255 | A | 6/1988 | Sanders |
| 4,755,792 | A | 7/1988 | Pezzolo |
| 4,758,835 | A | 7/1988 | Rathmann |
| 4,761,808 | A | 8/1988 | Howard |
| 4,779,090 | A | 10/1988 | Micznik |
| 4,794,268 | A | 12/1988 | Nakano |
| 4,794,622 | A | 12/1988 | Isaacman |
| 4,796,181 | A | 1/1989 | Wiedemer |
| 4,799,061 | A | 1/1989 | Abraham |
| 4,800,590 | A | 1/1989 | Vaughan |
| 4,802,114 | A | 1/1989 | Sogame |
| 4,804,938 | A | 2/1989 | Rouse |
| 4,807,052 | A | 2/1989 | Amano |
| 4,808,995 | A | 2/1989 | Clark |
| 4,825,200 | A | 4/1989 | Evans |
| 4,825,210 | A | 4/1989 | Bachhuber |
| 4,829,296 | A | 5/1989 | Clark |
| 4,831,509 | A | 5/1989 | Jones |
| 4,835,407 | A | 5/1989 | Kataoka |
| 4,845,491 | A | 7/1989 | Fascenda |
| 4,847,614 | A | 7/1989 | Keller |
| 4,850,046 | A | 7/1989 | Philippe |
| 4,855,713 | A | 8/1989 | Brunius |
| 4,856,062 | A | 8/1989 | Weiss |
| 4,856,081 | A | 8/1989 | Smith |
| 4,859,990 | A | 8/1989 | Isaacman |
| 4,870,400 | A | 9/1989 | Downs |
| 4,878,052 | A | 10/1989 | Schulze |
| 4,881,148 | A | 11/1989 | Lambropoulos |
| 4,885,778 | A | 12/1989 | Weiss |
| 4,888,575 | A | 12/1989 | De Vaulx |
| 4,890,108 | A | 12/1989 | Drori |
| 4,893,338 | A | 1/1990 | Pastor |
| 4,905,279 | A | 2/1990 | Nishio |
| 4,910,750 | A | 3/1990 | Fisher |
| 4,912,463 | A | 3/1990 | Li |
| 4,914,696 | A | 4/1990 | Dudczak |
| 4,918,690 | A | 4/1990 | Markkula |
| 4,922,168 | A | 5/1990 | Waggamon |
| 4,922,533 | A | 5/1990 | Philippe |
| 4,928,098 | A | 5/1990 | Dannhaeuser |
| 4,931,789 | A | 6/1990 | Pinnow |
| 4,939,792 | A | 7/1990 | Urbish |
| 4,942,393 | A | 7/1990 | Waraksa |
| 4,951,029 | A | 8/1990 | Severson |
| 4,963,876 | A | 10/1990 | Sanders |
| 4,979,832 | A | 12/1990 | Ritter |
| 4,980,913 | A | 12/1990 | Skret |
| 4,988,990 | A | 1/1991 | Warrior |
| 4,988,992 | A | 1/1991 | Heitschel |
| 4,992,783 | A | 2/1991 | Zdunek |
| 4,999,622 | A | 3/1991 | Amano |
| 5,001,332 | A | 3/1991 | Schrenk |
| 5,021,776 | A | 6/1991 | Anderson |
| 5,023,908 | A | 6/1991 | Weiss |
| 5,049,867 | A | 9/1991 | Stouffer |
| 5,055,701 | A | 10/1991 | Takeuchi |
| 5,058,161 | A | 10/1991 | Weiss |
| 5,060,263 | A | 10/1991 | Bosen |
| 5,091,942 | A | 2/1992 | Dent |
| 5,103,221 | A | 4/1992 | Memmola |

(56) References Cited

U.S. PATENT DOCUMENTS 5,107,258 A 4/1992 Soum
5,126,959 A 6/1992 Kurihara
5,136,548 A 8/1992 Claar
5,144,667 A 9/1992 Pogue
5,146,067 A 9/1992 Sloan
5,148,159 A 9/1992 Clark
5,150,464 A 9/1992 Sidhu
5,153,581 A 10/1992 Hazard
5,159,329 A 10/1992 Lindmayer
5,168,520 A 12/1992 Weiss
5,193,210 A 3/1993 Nicholas
5,197,061 A 3/1993 Halbert-Lassalle
5,220,263 A 6/1993 Onishi
5,224,163 A 6/1993 Gasser
5,237,614 A 8/1993 Weiss
5,252,960 A 10/1993 Duhame
5,278,907 A 1/1994 Snyder
5,280,527 A 1/1994 Gullman
5,331,325 A 7/1994 Miller
5,361,062 A 11/1994 Weiss
5,363,448 A 11/1994 Koopman
5,365,225 A 11/1994 Bachhuber
5,367,572 A 11/1994 Weiss
5,369,706 A 11/1994 Latka
5,412,379 A 5/1995 Waraksa
5,414,418 A 5/1995 Andros
5,420,925 A 5/1995 Michaels
5,442,340 A 8/1995 Dykema
5,442,341 A 8/1995 Lambropoulos
5,444,737 A 8/1995 Cripps
5,463,376 A 10/1995 Stoffer
5,471,668 A 11/1995 Soenen
5,473,318 A 12/1995 Martel
5,479,512 A 12/1995 Weiss
5,485,519 A 1/1996 Weiss
5,517,187 A 5/1996 Bruwer
5,528,621 A 6/1996 Heiman
5,530,697 A 6/1996 Watanabe
5,554,977 A 9/1996 Jablonski
RE35,364 E 10/1996 Heitschel
5,563,600 A 10/1996 Miyake
5,565,812 A 10/1996 Soenen
5,566,359 A 10/1996 Corrigan
5,576,701 A 11/1996 Heitschel
5,578,999 A 11/1996 Matsuzawa
5,594,429 A 1/1997 Nakahara
5,596,317 A 1/1997 Brinkmeyer
5,598,475 A 1/1997 Soenen
5,600,653 A 2/1997 Chitre
5,608,723 A 3/1997 Felsenstein
5,614,891 A 3/1997 Zeinstra
5,635,913 A 6/1997 Willmott
5,657,388 A 8/1997 Weiss
5,673,017 A 9/1997 Dery
5,678,213 A 10/1997 Myer
5,680,131 A 10/1997 Utz
5,686,904 A 11/1997 Bruwer
5,699,065 A 12/1997 Murray
5,719,619 A 2/1998 Hattori et al.
5,745,068 A 4/1998 Takahashi
5,774,065 A 6/1998 Mabuchi
5,778,348 A 7/1998 Manduley
5,838,747 A 11/1998 Matsumoto
5,872,513 A 2/1999 Fitzgibbon
5,872,519 A 2/1999 Issa
5,898,397 A 4/1999 Murray
5,923,758 A 7/1999 Khamharn
5,936,999 A 8/1999 Keskitalo
5,937,065 A 8/1999 Simon
5,942,985 A 8/1999 Chin
5,949,349 A 9/1999 Farris
6,012,144 A 1/2000 Pickett
6,037,858 A 3/2000 Seki
6,049,289 A 4/2000 Waggamon
6,052,408 A 4/2000 Trompower
6,070,154 A 5/2000 Tavor
6,094,575 A 7/2000 Anderson et al.
6,130,602 A 10/2000 O'Toole
6,137,421 A 10/2000 Dykema
6,140,938 A 10/2000 Flick
6,154,544 A 11/2000 Farris
6,157,719 A 12/2000 Wasilewski
6,166,650 A 12/2000 Bruwer
6,175,312 B1 1/2001 Bruwer
6,181,255 B1 1/2001 Crimmins
6,229,434 B1 5/2001 Knapp
6,243,000 B1 6/2001 Tsui
6,275,519 B1 8/2001 Hendrickson
6,366,051 B1 4/2002 Nantz
6,396,446 B1 5/2002 Walstra
6,414,587 B1 7/2002 Fitzgibbon
6,414,986 B1 7/2002 Usui
6,456,726 B1 9/2002 Yu
6,463,538 B1 10/2002 Elteto
6,496,477 B1 12/2002 Perkins
6,535,544 B1 3/2003 Partyka
6,549,949 B1 4/2003 Bowman-Amuah
6,609,796 B2 8/2003 Maki et al.
6,640,244 B1 10/2003 Bowman-Amuah
6,658,328 B1 12/2003 Alrabady
6,688,518 B1 2/2004 Valencia
6,690,796 B1 2/2004 Farris
6,697,379 B1 2/2004 Jacquet
6,703,941 B1 3/2004 Blaker
6,754,266 B2 6/2004 Bahl
6,778,064 B1 8/2004 Yamasaki
6,810,123 B2 10/2004 Farris
6,829,357 B1 12/2004 Alrabady
6,842,106 B2 1/2005 Hughes
6,850,910 B1 2/2005 Yu
6,861,942 B1 3/2005 Knapp
6,917,801 B2 7/2005 Witte
6,930,983 B2 8/2005 Perkins
6,956,460 B2 10/2005 Tsui
6,963,270 B1 11/2005 Gallagher, III
6,963,561 B1 11/2005 Lahat
6,978,126 B1 12/2005 Blaker
6,980,518 B1 12/2005 Sun
6,980,655 B2 12/2005 Farris
6,988,977 B2 2/2006 Gregori
6,998,977 B2 2/2006 Gregori
7,002,490 B2 2/2006 Lablans
7,039,397 B2 5/2006 Chuey
7,039,809 B1 5/2006 Wankmueller
7,042,363 B2 5/2006 Katrak
7,050,479 B1 5/2006 Kim
7,050,794 B2 5/2006 Chuey et al.
7,057,494 B2 6/2006 Fitzgibbon
7,057,547 B2 6/2006 Olmsted
7,068,181 B2 6/2006 Chuey
7,071,850 B1 7/2006 Fitzgibbon
7,088,218 B2 8/2006 Chuey
7,088,265 B2 8/2006 Tsui
7,088,706 B2 8/2006 Zhang et al.
7,139,398 B2 11/2006 Candelore
7,161,466 B2 * 1/2007 Chuey ..... G08C 17/02
455/418
7,205,908 B2 4/2007 Tsui
7,221,256 B2 5/2007 Skekloff
7,257,426 B1 8/2007 Witkowski
7,266,344 B2 9/2007 Rodriquez
7,289,014 B2 10/2007 Mullet
7,290,886 B2 11/2007 Cheng
7,298,721 B2 11/2007 Atarashi et al.
7,301,900 B1 11/2007 Laksono
7,332,999 B2 2/2008 Fitzgibbon
7,333,615 B1 2/2008 Jarboe
7,336,787 B2 2/2008 Unger
7,346,163 B2 3/2008 Pedlow
7,346,374 B2 3/2008 Witkowski
7,349,722 B2 3/2008 Witkowski
7,353,499 B2 4/2008 De Jong
7,406,553 B2 7/2008 Edirisooriya et al.
7,412,056 B2 8/2008 Farris

(56) References Cited

U.S. PATENT DOCUMENTS 7,415,618 B2 8/2008 De Jong
7,429,898 B2 9/2008 Akiyama
7,447,498 B2 11/2008 Chuey et al.
7,469,129 B2 12/2008 Blaker
7,489,922 B2 2/2009 Chuey
7,492,898 B2 2/2009 Farris et al.
7,492,905 B2 2/2009 Fitzgibbon
7,493,140 B2 2/2009 Mark
7,516,325 B2 4/2009 Willey
7,532,965 B2 5/2009 Robillard
7,535,926 B1 5/2009 Deshpande
7,545,942 B2 6/2009 Cohen et al.
7,548,153 B2 6/2009 Gravelle et al.
7,561,075 B2 7/2009 Fitzgibbon
7,564,827 B2 7/2009 Das et al.
7,598,855 B2 10/2009 Scalisi et al.
7,623,663 B2 11/2009 Farris
7,668,125 B2 2/2010 Kadous
7,741,951 B2 6/2010 Fitzgibbon
7,742,501 B2 6/2010 Williams
7,757,021 B2 7/2010 Wenzel
7,764,613 B2 7/2010 Miyake et al.
7,786,843 B2 8/2010 Witkowski
7,812,739 B2 10/2010 Chuey
7,839,263 B2 11/2010 Shearer
7,839,851 B2 11/2010 Kozat
7,855,633 B2 12/2010 Chuey
7,864,070 B2 1/2011 Witkowski
7,889,050 B2 2/2011 Witkowski
7,911,358 B2 3/2011 Bos
7,920,601 B2 4/2011 Andrus
7,970,446 B2 6/2011 Witkowski
7,973,678 B2 7/2011 Petricoin, Jr.
7,979,173 B2 7/2011 Breed
7,999,656 B2 8/2011 Fisher
8,000,667 B2 8/2011 Witkowski
8,014,377 B2 9/2011 Zhang et al.
8,031,047 B2 10/2011 Skekloff
8,049,595 B2 11/2011 Olson
8,103,655 B2 1/2012 Srinivasan
8,111,179 B2 2/2012 Turnbull
8,130,079 B2 3/2012 McQuaide, Jr. et al.
8,138,883 B2 3/2012 Shearer
8,174,357 B2 5/2012 Geerlings
8,194,856 B2 6/2012 Farris
8,200,214 B2 6/2012 Chutorash
8,207,818 B2 6/2012 Keller, Jr.
8,208,888 B2 6/2012 Chutorash
8,209,550 B2 6/2012 Gehrmann
8,225,094 B2 7/2012 Willey
8,233,625 B2 7/2012 Farris
8,253,528 B2 8/2012 Blaker
8,264,333 B2 9/2012 Blaker
8,266,442 B2 9/2012 Burke
8,276,185 B2 9/2012 Messina et al.
8,284,021 B2 10/2012 Farris et al.
8,290,465 B2 10/2012 Ryu et al.
8,311,490 B2 11/2012 Witkowski
8,330,569 B2 12/2012 Blaker
8,384,513 B2 2/2013 Witkowski
8,384,580 B2 2/2013 Witkowski
8,416,054 B2 4/2013 Fitzgibbon
8,422,667 B2 4/2013 Fitzgibbon
8,452,267 B2 5/2013 Friman
8,463,540 B2 6/2013 Hannah et al.
8,494,547 B2 7/2013 Nigon
8,531,266 B2 9/2013 Shearer
8,536,977 B2 9/2013 Fitzgibbon
8,544,523 B2 10/2013 Mays
8,581,695 B2 11/2013 Carlson et al.
8,615,562 B1 12/2013 Huang et al.
8,633,797 B2 1/2014 Farris et al.
8,634,777 B2 1/2014 Ekbatani et al.
8,634,888 B2 1/2014 Witkowski
8,643,465 B2 2/2014 Fitzgibbon
8,645,708 B2 2/2014 Labaton
8,661,256 B2 2/2014 Willey
8,699,704 B2 4/2014 Liu et al.
8,760,267 B2 6/2014 Bos et al.
8,787,823 B2 7/2014 Justice et al.
8,830,925 B2 9/2014 Kim et al.
8,836,469 B2 9/2014 Fitzgibbon et al.
8,837,608 B2 9/2014 Witkowski
8,843,066 B2 9/2014 Chutorash
8,878,646 B2 11/2014 Chutorash
8,918,244 B2 12/2014 Brzezinski
8,981,898 B2 3/2015 Sims
9,007,168 B2 4/2015 Bos
9,024,801 B2 5/2015 Witkowski
9,082,293 B2 7/2015 Wellman et al.
9,122,254 B2 * 9/2015 Cate ..... E05F 15/70
9,124,424 B2 9/2015 Aldis
9,142,064 B2 9/2015 Muetzel et al.
9,160,408 B2 10/2015 Krohne et al.
9,189,952 B2 11/2015 Chutorash
9,229,905 B1 1/2016 Penilla
9,230,378 B2 1/2016 Chutorash
9,264,085 B2 2/2016 Pilat
9,280,704 B2 3/2016 Lei et al.
9,317,983 B2 4/2016 Ricci
9,318,017 B2 4/2016 Witkowski
9,324,230 B2 4/2016 Chutorash
9,336,637 B2 5/2016 Neil et al.
9,367,978 B2 6/2016 Sullivan
9,370,041 B2 6/2016 Witkowski
9,396,376 B1 7/2016 Narayanaswami
9,396,598 B2 7/2016 Daniel-Wayman
9,413,453 B2 8/2016 Sugitani et al.
9,418,326 B1 8/2016 Narayanaswami
9,430,939 B2 8/2016 Shearer
9,443,422 B2 9/2016 Pilat
9,449,449 B2 9/2016 Evans
9,539,930 B2 1/2017 Geerlings
9,552,723 B2 1/2017 Witkowski
9,576,408 B2 2/2017 Hendricks
9,614,565 B2 4/2017 Pilat
9,620,005 B2 4/2017 Geerlings
9,640,005 B2 5/2017 Geerlings
9,652,907 B2 5/2017 Geerlings
9,652,978 B2 5/2017 Wright
9,679,471 B2 6/2017 Geerlings
9,691,271 B2 6/2017 Geerlings
9,711,039 B2 7/2017 Shearer
9,715,772 B2 7/2017 Bauer
9,715,825 B2 7/2017 Geerlings
9,791,861 B2 10/2017 Keohane
9,811,085 B1 11/2017 Hayes
9,811,958 B1 11/2017 Hall
9,819,498 B2 11/2017 Vuyst
9,836,905 B2 12/2017 Chutorash
9,836,955 B2 12/2017 Papay
9,836,956 B2 12/2017 Shearer
9,858,806 B2 1/2018 Geerlings
9,875,650 B2 1/2018 Witkowski
9,916,769 B2 3/2018 Wright
9,922,548 B2 3/2018 Geerlings
9,947,159 B2 4/2018 Geerlings
9,965,947 B2 5/2018 Geerlings
9,984,516 B2 5/2018 Geerlings
10,008,109 B2 6/2018 Witkowski
10,045,183 B2 8/2018 Chutorash
10,062,229 B2 8/2018 Zeinstra
10,096,186 B2 10/2018 Geerlings
10,096,188 B2 10/2018 Geerlings
10,097,680 B2 10/2018 Bauer
10,127,804 B2 11/2018 Geerlings
10,147,310 B2 12/2018 Geerlings
10,163,337 B2 12/2018 Geerlings
10,163,366 B2 12/2018 Wright
10,176,708 B2 1/2019 Geerlings
10,198,938 B2 2/2019 Geerlings
10,217,303 B1 2/2019 Hall
10,229,548 B2 3/2019 Daniel-Wayman
10,282,977 B2 5/2019 Witkowski

(56) References Cited

U.S. PATENT DOCUMENTS 10,553,050 B1 2/2020 Romero
10,614,650 B2 4/2020 Minsley
10,652,743 B2 5/2020 Fitzgibbon
10,997,810 B2 5/2021 Atwell
11,074,773 B1 7/2021 Morris
11,122,430 B2 9/2021 Fitzgibbon
11,423,717 B2 8/2022 Cate
2001/0023483 A1 9/2001 Kiyomoto
2002/0034303 A1 3/2002 Farris
2002/0183008 A1 12/2002 Menard
2002/0184504 A1 12/2002 Hughes
2002/0191785 A1 12/2002 McBrearty
2002/0191794 A1 12/2002 Farris
2003/0025793 A1 2/2003 McMahon
2003/0033540 A1 2/2003 Fitzgibbon
2003/0051155 A1 3/2003 Martin
2003/0056001 A1 3/2003 Mate
2003/0070092 A1 4/2003 Hawkes
2003/0072445 A1 4/2003 Kuhlman
2003/0118187 A1 6/2003 Fitzgibbon
2003/0141987 A1 7/2003 Hayes
2003/0147536 A1 8/2003 Andivahis
2003/0177237 A1 9/2003 Stebbings
2003/0190906 A1 10/2003 Winick
2003/0191949 A1 10/2003 Odagawa
2003/0227370 A1 12/2003 Brookbank
2004/0019783 A1 1/2004 Hawkes
2004/0046639 A1 3/2004 Giehler
2004/0054906 A1 3/2004 Carro
2004/0081075 A1 4/2004 Tsukakoshi
2004/0174856 A1 9/2004 Brouet
2004/0179485 A1 9/2004 Terrier
2004/0181569 A1 9/2004 Attar
2004/0257200 A1 12/2004 Baumgardner
2005/0053022 A1 3/2005 Zettwoch
2005/0058153 A1 3/2005 Santhoff
2005/0060555 A1 3/2005 Raghunath
2005/0101314 A1 5/2005 Levi
2005/0151667 A1 7/2005 Hetzel
2005/0174242 A1 8/2005 Cohen
2005/0285719 A1 12/2005 Stephens
2006/0020796 A1 1/2006 Aura
2006/0046794 A1 3/2006 Scherschel
2006/0083187 A1 4/2006 Dekel
2006/0097843 A1 5/2006 Libin
2006/0103503 A1 5/2006 Rodriquez
2006/0109978 A1 5/2006 Farris
2006/0164208 A1 7/2006 Schaffzin
2006/0176171 A1 8/2006 Fitzgibbon
2006/0224512 A1 10/2006 Kurakata
2006/0232377 A1 10/2006 Witkowski
2007/0005806 A1 1/2007 Fitzgibbon
2007/0006319 A1 1/2007 Fitzgibbon
2007/0018861 A1 1/2007 Fitzgibbon
2007/0058811 A1 3/2007 Fitzgibbon
2007/0167138 A1 7/2007 Bauman
2007/0245147 A1 10/2007 Okeya
2008/0194291 A1 8/2008 Martin
2008/0224886 A1 9/2008 Rodriguez et al.
2008/0229400 A1 9/2008 Burke
2008/0291047 A1 11/2008 Summerford
2008/0297370 A1 12/2008 Farris
2008/0303630 A1 12/2008 Martinez
2009/0016530 A1 1/2009 Farris
2009/0021348 A1 1/2009 Farris
2009/0096621 A1 4/2009 Ferlitsch
2009/0176451 A1 7/2009 Yang et al.
2009/0313095 A1 12/2009 Hurpin
2009/0315672 A1* 12/2009 Nantz ..... G08C 17/02 340/5.21
2010/0029261 A1 2/2010 Mikkelsen
2010/0060413 A1 3/2010 Fitzgibbon et al.
2010/0112979 A1 5/2010 Chen et al.
2010/0125509 A1 5/2010 Kranzley et al.
2010/0125516 A1 5/2010 Wankmueller et al.
2010/0159846 A1* 6/2010 Witkowski ..... G07C 9/00857 455/70
2010/0199092 A1 8/2010 Andrus et al.
2010/0211779 A1 8/2010 Sundaram
2011/0037574 A1 2/2011 Pratt
2011/0051927 A1 3/2011 Murray et al.
2011/0205014 A1 8/2011 Fitzgibbon
2011/0218965 A1 9/2011 Lee
2011/0225451 A1 9/2011 Leggette
2011/0227698 A1 9/2011 Witkowski
2011/0273268 A1 11/2011 Bassali
2011/0287757 A1 11/2011 Nykoluk
2011/0296185 A1 12/2011 Kamarthy et al.
2011/0316668 A1 12/2011 Laird
2011/0316688 A1 12/2011 Ranjan
2011/0317835 A1 12/2011 Laird
2011/0320803 A1 12/2011 Hampel et al.
2012/0054493 A1 3/2012 Bradley
2012/0133841 A1 5/2012 Vanderhoff
2012/0191770 A1 7/2012 Perlmutter
2012/0254960 A1 10/2012 Lortz
2012/0297681 A1 11/2012 Krupke et al.
2013/0017812 A1 1/2013 Foster
2013/0063243 A1 3/2013 Witkowski
2013/0088326 A1 4/2013 Bassali
2013/0147600 A1 6/2013 Murray
2013/0170639 A1 7/2013 Fitzgibbon
2013/0268333 A1 10/2013 Ovick et al.
2013/0272520 A1 10/2013 Noda et al.
2013/0304863 A1 11/2013 Reber
2014/0125499 A1 5/2014 Cate
2014/0169247 A1 6/2014 Jafarian et al.
2014/0245284 A1 8/2014 Alrabady
2014/0266589 A1 9/2014 Wilder
2014/0282929 A1 9/2014 Tse
2014/0289528 A1 9/2014 Baghdasaryan
2014/0327690 A1 11/2014 McGuire
2014/0361866 A1 12/2014 Evans
2015/0002262 A1 1/2015 Geerlings
2015/0022436 A1 1/2015 Cho
2015/0084750 A1 3/2015 Fitzgibbon
2015/0116082 A1* 4/2015 Cregg ..... E05B 45/00 340/5.61
2015/0139423 A1 5/2015 Hildebrandt
2015/0161832 A1 6/2015 Esselink
2015/0187019 A1 7/2015 Fernandes
2015/0222436 A1 8/2015 Morten
2015/0222517 A1 8/2015 McLaughlin et al.
2015/0235172 A1 8/2015 Hall
2015/0235173 A1 8/2015 Hall
2015/0235493 A1 8/2015 Hall
2015/0235495 A1 8/2015 Hall
2015/0261521 A1 9/2015 Choi
2015/0310737 A1 10/2015 Simanowski
2015/0310765 A1 10/2015 Wright
2015/0358814 A1 12/2015 Roberts
2016/0009188 A1 1/2016 Yokoyama
2016/0020813 A1 1/2016 Pilat
2016/0021140 A1 1/2016 Fitzgibbon
2016/0043762 A1 2/2016 Turnbull
2016/0101736 A1 4/2016 Geerlings
2016/0104374 A1 4/2016 Ypma
2016/0125357 A1 5/2016 Hall
2016/0145903 A1 5/2016 Taylor
2016/0196706 A1 7/2016 Tehranchi
2016/0198391 A1 7/2016 Orthmann et al.
2016/0203721 A1 7/2016 Wright
2016/0261572 A1 9/2016 Liu et al.
2016/0359629 A1 12/2016 Nadathur
2017/0061110 A1 3/2017 Wright
2017/0079082 A1 3/2017 Papay
2017/0113619 A1 4/2017 Boehm
2017/0140643 A1 5/2017 Puppo
2017/0225526 A1* 8/2017 Tomakidi ..... G07C 9/00309
2017/0230509 A1 8/2017 Lablans
2017/0316628 A1 11/2017 Farber
2017/0320464 A1 11/2017 Schultz
2017/0323498 A1 11/2017 Bauer
2017/0352286 A1 12/2017 Witkowski

(56) References Cited

U.S. PATENT DOCUMENTS

| | | | |
|---|---|---|---|
| 2017/0364719 | A1 | 12/2017 | Boehm |
| 2017/0372574 | A1 | 12/2017 | Linsky |
| 2018/0052860 | A1 | 2/2018 | Hayes |
| 2018/0053237 | A1 | 2/2018 | Hayes |
| 2018/0118045 | A1 | 5/2018 | Gruzen |
| 2018/0123806 | A1 | 5/2018 | Vuyst |
| 2018/0184376 | A1 | 6/2018 | Geerlings |
| 2018/0225959 | A1 | 8/2018 | Witkowski |
| 2018/0232981 | A1 | 8/2018 | Geerlings |
| 2018/0234843 | A1 | 8/2018 | Smyth |
| 2018/0245559 | A1* | 8/2018 | Kang ..... G07C 9/00944 |
| 2018/0246515 | A1 | 8/2018 | Iwama |
| 2018/0276613 | A1 | 9/2018 | Hall |
| 2018/0285814 | A1 | 10/2018 | Hall |
| 2018/0367419 | A1 | 12/2018 | Hall |
| 2019/0082149 | A1 | 3/2019 | Correnti |
| 2019/0085615 | A1 | 3/2019 | Cate |
| 2019/0102962 | A1 | 4/2019 | Miller |
| 2019/0200225 | A1 | 6/2019 | Fitzgibbon |
| 2019/0208024 | A1 | 7/2019 | Jablonski |
| 2019/0228603 | A1 | 7/2019 | Fowler |
| 2019/0244448 | A1 | 8/2019 | Alamin |
| 2020/0027054 | A1 | 1/2020 | Hall |
| 2020/0043270 | A1 | 2/2020 | Cate |
| 2020/0074753 | A1 | 3/2020 | Adiga |
| 2020/0208461 | A1 | 7/2020 | Virgin |
| 2020/0236552 | A1 | 7/2020 | Fitzgibbon |
| 2020/0364961 | A1 | 11/2020 | Atwell |
| 2021/0385651 | A1 | 12/2021 | Fitzgibbon |

FOREIGN PATENT DOCUMENTS

| | | | |
|---|---|---|---|
| AU | 2006200340 | | 8/2006 |
| AU | 2007203558 | B2 | 2/2008 |
| AU | 2008202369 | A1 | 1/2009 |
| AU | 2011202656 | A1 | 1/2012 |
| AU | 2011218848 | A1 | 9/2012 |
| CA | 2087722 | C | 7/1998 |
| CA | 2193846 | C | 2/2004 |
| CA | 2551295 | | 12/2006 |
| CA | 2926281 | | 2/2008 |
| CA | 2177410 | C | 4/2008 |
| CA | 2443452 | C | 7/2008 |
| CA | 2684658 | A1 | 10/2008 |
| CA | 2708000 | A1 | 12/2010 |
| CA | 2456680 | C | 2/2011 |
| CA | 2742018 | A1 | 12/2011 |
| CA | 2565505 | C | 9/2012 |
| CA | 2631076 | C | 9/2013 |
| CA | 2790940 | C | 6/2014 |
| CA | 2596188 | C | 7/2016 |
| CN | 101399825 | A | 4/2009 |
| DE | 102010015104 | | 11/1957 |
| DE | 3234538 | A1 | 3/1984 |
| DE | 3234539 | A1 | 3/1984 |
| DE | 3244049 | A1 | 9/1984 |
| DE | 3309802 | A1 | 9/1984 |
| DE | 3309802 | C2 | 9/1984 |
| DE | 3320721 | | 12/1984 |
| DE | 3332721 | A1 | 3/1985 |
| DE | 3407436 | A1 | 8/1985 |
| DE | 3407469 | A1 | 9/1985 |
| DE | 3532156 | A1 | 3/1987 |
| DE | 3636822 | C1 | 10/1987 |
| DE | 4204463 | | 8/1992 |
| DE | 102006003808 | | 11/2006 |
| DE | 102007036647 | | 2/2008 |
| EP | 0043270 | A1 | 1/1982 |
| EP | 0103790 | A2 | 3/1984 |
| EP | 0154019 | A1 | 9/1985 |
| EP | 0155378 | A1 | 9/1985 |
| EP | 0244322 | | 11/1987 |
| EP | 0244332 | B1 | 11/1987 |
| EP | 0311112 | A2 | 4/1989 |
| EP | 0335912 | | 10/1989 |
| EP | 0372285 | | 6/1990 |
| EP | 0265935 | B1 | 5/1991 |
| EP | 0459781 | | 12/1991 |
| EP | 0857842 | | 8/1998 |
| EP | 0870889 | | 10/1998 |
| EP | 0937845 | A1 | 8/1999 |
| EP | 1024626 | A1 | 8/2000 |
| EP | 1223700 | | 7/2002 |
| EP | 1313260 | | 5/2003 |
| EP | 1421728 | A1 | 5/2004 |
| EP | 1625560 | A1 | 2/2006 |
| EP | 1760985 | A2 | 3/2007 |
| EP | 0771498 | B1 | 5/2007 |
| EP | 1865656 | A1 | 12/2007 |
| EP | 2293478 | A2 | 3/2011 |
| EP | 2149103 | B1 | 12/2011 |
| EP | 2437212 | A1 | 4/2012 |
| EP | 1875333 | B1 | 1/2013 |
| EP | 2290872 | B1 | 6/2014 |
| EP | 2800403 | A1 | 11/2014 |
| FR | 2606232 | | 5/1988 |
| FR | 2607544 | | 6/1988 |
| FR | 2685520 | | 6/1993 |
| FR | 2737373 | | 1/1997 |
| GB | 218774 | | 7/1924 |
| GB | 1156279 | | 6/1969 |
| GB | 2023899 | | 1/1980 |
| GB | 2051442 | | 1/1981 |
| GB | 2099195 | | 12/1982 |
| GB | 2118614 | | 11/1983 |
| GB | 2131992 | | 6/1984 |
| GB | 2133073 | | 7/1984 |
| GB | 2184774 | | 7/1987 |
| GB | 2254461 | | 10/1992 |
| GB | 2265482 | | 9/1993 |
| GB | 2288261 | | 10/1995 |
| GB | 2430115 | | 3/2007 |
| GB | 2440816 | | 2/2008 |
| GB | 2453383 | A | 4/2009 |
| JP | H6205474 | | 7/1994 |
| JP | 09322274 | | 12/1997 |
| KR | 20050005150 | | 1/2005 |
| KR | 20060035951 | | 4/2006 |
| WO | 9300137 | | 1/1993 |
| WO | 9301140 | | 1/1993 |
| WO | 9320538 | | 10/1993 |
| WO | 9400147 | | 1/1994 |
| WO | 9411829 | | 5/1994 |
| WO | 9418036 | | 8/1994 |
| WO | 0010301 | | 2/2000 |
| WO | 0010302 | | 2/2000 |
| WO | 03010656 | | 2/2003 |
| WO | 03079607 | A1 | 9/2003 |
| WO | 2008082482 | | 7/2008 |
| WO | 2011106199 | | 9/2011 |
| WO | 2019126453 | | 6/2019 |
| ZA | 8908225 | | 10/1991 |

OTHER PUBLICATIONS

US 10,135,479 B2, 11/2018, Turnbull (withdrawn)

European Patent Application No. 10 183 420.8; Communication Pursuant to Article 94(3) EPC dated May 4, 2020.

U.S. Appl. No. 17/194,923, filed Mar. 8, 2021; 34 pages.

U.S. Appl. No. 17/245,672, filed Apr. 30, 2021, 47 pages.

USPTO, U.S. Appl. No. 16/454,978; Notice of Allowance dated Feb. 16, 2021, 9 pages.

USPTO; U.S. Appl. No. 16/843,119; Office Action dated Feb. 2, 2021, 24 pages.

USPTO; U.S. Appl. No. 16/843,119; Supplemental Notice of Allowability dated May 25, 2021, 2 pages.

USPTO; U.S. Appl. No. 16/843,119; Notice of Allowance dated May 11, 2021, 5 pages.

'Access Transmitters—Access Security System', pp. 1-2, Dated Jul. 16, 1997. http://www.webercreations.com/access/security.html.

About us—ParqEx, 5 pages, Wayback Machine capture dated May 5, 2018, 5 pages, retrieved from https://web.archive.org/web/20180505051951/https://www.parqex.com/about-parqex/.

(56) References Cited

OTHER PUBLICATIONS

Abrams, and Podell, 'Tutorial Computer and Network Security,' District of Columbia: IEEE, 1987. pp. 1075-1081.
Abramson, Norman. 'The Aloha System—Another alternative for computer communications,' pp. 281-285, University of Hawaii, 1970.
Adams, Russ, Classified, data-scrambling program for Apple II, Info-World, vol. 5, No. 3; Jan. 31, 1988.
Alexi, Werner, et al. 'RSA and Rabin Functions: Certain Parts are as Hard as the Whole', pp. 194-209, Siam Computing, vol. 14, No. 2, Apr. 1988.
Allianz: Allianz-Zentrum for Technik GmbH—Detailed Requirements for Fulfilling the Specification Profile for Electronically Coded OEM Immobilizers, Issue 22, (Jun. 1994 (Translation Jul. 5, 1994).
Anderson, Ross. 'Searching for the Optium Correlation Attack', pp. 137-143, Computer Laboratory, Pembroke Street, Cambridge CB2 3QG, Copyright 1995.
Arazi, Benjamin, Vehicular Implementations of Public Key Cryptographic Techniques, IEEE Transactions on Vehicular Technology, vol. 40, No. 3, Aug. 1991, 646-653.
Baran, P. Distribution Communications, vol. 9, 'Security Secrecy and Tamper-free Communications', Rand Corporation, 1964.
Barbaroux, Paul. 'Uniform Results in. Polynomial-Time Security', pp. 297-306, Advances in Cryptology—Eurocrypt 92, 1992.
Barlow, Mike, 'A Mathematical Word Block Cipher,' 12 Cryptologia 256-264 (1988).
Bellovin, S.M. 'Security Problems in the TCPIIP Protocol Suite', pp. 32-49, Computer Communication Review, New Jersey, Reprinted from Computer Communication Review, vol. 19, No. 2, pp. 32-48, Apr. 1989.
Beutelspacher, Albrecht. Advances in Cryptology—Eurocrypt 87: 'Perfect and Essentially Perfect Authentication Schemes' (Extended Abstract), pp. 167-170, Federal Republic of Germany, believed to be publicly available prior to Jun. 30, 2004.
Bloch, Gilbert. Enigma Before Ultra Polish Work and The French Contribution, pp. 142-155, Cryptologia 11(3), (Jul. 1987).
Bosworth, Bruce, 'Codes, Ciphers, and Computers: An Introduction to Information Security' Hayden Book Company, Inc. 1982, pp. 30-54.
Brickell, Ernest F. and Stinson, Doug. 'Authentication Codes With Multiple Arbiters', pp. 51-55, Proceedings of Eurocrypt 88, 1988.
Bruwer, Frederick J. 'Die Toepassing Van Gekombineerde Konvolusiekodering en Modulasie op HF-Datakommunikasie,' District of Pretoria in South Africa Jul. 1998.
Burger, Chris R., Secure Learning RKE Systems Using KeeLoq. RTM. Encoders, TB001, 1996 Microchip Technology, Inc., 1-7.
Burmeister, Mike. A Remark on the Effiency of Identification Schemes, pp. 493-495, Advances in Cryptology—Eurocrypt 90, (1990).
Cattermole, K.W., 'Principles of Pulse Code Modulation' Iliffe Books Ltd., 1969, pp. 30-381.
Cerf, Vinton a 'Issues in Packet-Network Interconnection', pp. 1386-1408, Proceedings of the IEEE, 66(11), Nov. 1978.
Cerf, Vinton G. and Kahn, Robert E. 'A Protocol for Packet Network Intercommunication', pp. 637-648, Transactions on Communications, vol. Com-22, No. 5, May 1974.
Charles Watts, How to Program the HiSec(TM) Remote Keyless Entry Rolling Code Generator, National Semiconductor, Oct. 1994, 1-4.
Computer Arithmetic by Henry Jacobowitz; Library of Congress Catalog Card No. 62-13396; Copyright Mar. 1962 by John F. Rider Publisher, Inc.
Conner, Doug, Cryptographic Techniques—Secure Your Wireless Designs, EDN (Design Feature), Jan. 18, 1996, 57-68.
Coppersmith, Don. 'Fast Evalution of Logarithms in Fields of Characteristic Two', IT-30(4): pp. 587-594, IEEE Transactions on Information Theory, Jul. 1984.
Daniels, George, 'Pushbutton Controls for Garage Doors' Popular Science (Aug. 1959), pp. 156-160.
Davies, D.W. and Price, W.C. 'Security for Computer Networks,' John Wiley and Sons, 1984. Chapter 7, pp. 175-176.
Davies, Donald W, 'Tutorial: The Security of Data in Networks,' pp. 13-17, New York: IEEE, 1981.
Davis, Ben and De Long, Ron. Combined Remote Key Conrol and Immobilization System for Vehicle Security, pp. 125-132, Power Electronics in Transportation, IEEE Catalogue No. 96TH8184, (Oct. 24, 1996).
Davis, Gregory and Palmer, Morris. Self-Programming, Rolling-Code Technology Creates Nearly Unbreakable RF Security, Technological Horizons, Texas Instruments, Inc. (ECN), (Oct. 1996).
Deavours, C. A. and Reeds, James. The Enigma, Part 1, Historical Perspectives, pp. 381-391, Cryptologia, 1(4), (Oct. 1977).
Deavours, C.A. and Kruh, L. 'The Swedish HC-9 Ciphering Machine', 251-285, Cryptologia, 13(3): Jul. 1989.
Deavours, Cipher A., et al. 'Analysis of the Hebern cryptograph Using Isomorphs', pp. 246-261, Cryptology: Yesterday, Today and Tomorrow, vol. 1, No. 2, Apr. 1977.
Denning, Dorothy E. 'Cryptographic Techniques', pp. 135-154, Cryptography and Data Security, 1982. Chapter 3.
Denning, Dorothy E. A Lattice Model of Secure Information Flow, pp. 236-238, 240, 242, Communications of the ACM, vol. 19, No. 5, (May 1976).
Diffie and Hellman, Exhaustive Cryptanalysis of the NB.S Data Encryption Standard, pp. 74-84, Computer, Jun. 1977.
Diffie, Whitfield and Hellman, Martin E. New Directions in Cryptography, pp. 644-654, IEEE Transactions on Information Theory, vol. IT-22, No. 6, (Nov. 1976).
Diffie, Whitfield and Hellman, Martin E. Privacy and Authentication: An Introduction to Cryptography, pp. 397-427, Proceedings of the IEEE, vol. 67, No. 3 (Mar. 1979).
Diffie, Whitfield and Hellman, Martin, E. 'An RSA Laboratories Technical Note', Version 1.4, Revised Nov. 1, 1993.
Dijkstra, E. W. Co-Operating Sequential Processses, pp. 43-112, Programming Languages, F. Genuys. NY, believed to be publicly available prior to Jun. 30, 2004.
Dijkstra, E.W. 'Hierarchical Ordering of Sequential Processes', pp. 115-138, Acta Informatica 1: 115-138, Springer-Verlag (1971).
Eigamal, Taher. A Public Key Cryptosystem and a Signature Scheme Based on Discrete Logarithms, pp. 469-472, IEEE, Transactions on Information Theory, vol. IT-31, No. 4, (Jul. 1985).
Eigamal, Taher. A Subexponential Time Algorithm for Computing Discrete Logarithms, pp. 473-481, IEEE, Transactions on Information Theory, vol. IT-31, No. 4, (Jul. 1985).
Feistel, Horst, Notz, Wm. A. and Smith, J. Lynn. Some Cryptographic Techniques for Machine-to-Machine Data Communications, pp. 1545-1554, Proceedings of the IEEE, vol. 63, No. 11, (Nov. 1975).
Feistel, Horst. 'Cryptography and Computer Privacy', pp. 15-23, Scientific American, vol. 228, No. 5, May 1973.
Fenzl, H. and Kliner, A. Electronic Lock System: Convenient and Safe, pp. 150-153, Siemens Components XXI, No. 4, (1987).
Fischer, Elliot. Uncaging the Hagelin Cryptograph, pp. 89-92, Cryptologia, vol. 7, No. 1, (Jan. 1983).
Fragano, Maurizio. Solid State Key/Lock Security System, pp. 604-607, IEEE Transactions on Consumer Electronics, vol. CE-30, No. 4, (Nov. 1984).
G. Davis, Marcstar.TM. TRC1300 and TRC1315 Remote Control Transmitter/Receiver, Texas Instruments, Sep. 12, 1994. 1-24.
Godlewski, Ph. and Camion P. 'Manipulations and Errors, Delection and Localization,' pp. 97-106, Proceedings of Eurocrypt 88, 1988.
Gordon, Professor J., Police Scientific Development Branch, Designing Codes for Vehicle Remote Security Systems, (Oct. 1994), pp. 1-20.
Gordon, Professor J., Police Scientific Development Branch, Designing Rolling Codes for Vehicle Remote Security Systems, (Aug. 1993), pp. 1-19.
Greenlee, B.M., Requirements for Key Management Protocols in the Wholesale Financial Services Industry, pp. 22 28, IEEE Communications Magazine , Sep. 1985.

(56) References Cited

OTHER PUBLICATIONS

Guillou, Louis C. and Quisquater, Jean-Jacques. 'A Practical Zero-Knowledge Protocol Fitted to Security Microprocessor Minimizing Both Transmission and Memory', pp. 123-128, Advances in Cryptology—Eurocrypt 88, 1988.
Guillou, Louis C. Smart Cards and Conditional Access, pp. 481-489, Proceedings of Eurocrypt, (1984).
Habermann, A. Nico, Synchronization of Communicating Processes , pp. 171 176, Communications , Mar. 1972.
Hagelin C-35/C-36 (The), (1 page) Sep. 3, 1998. http://hem.passagen.se/tan01/C035.HTML.
Haykin, Simon, "An Introduction to Analog and Digital Communications" 213, 215 (1989).
IEEE 100; The Authoritative Dictionary of IEEE Standards Terms, Seventh Ediciton, Published by Standards Information Network, IEEE Press, Copyright 2000.
ISO 8732: 1988(E): Banking Key Management (Wholesale) Annex D: Windows and Windows Management, Nov. 1988.
Jones, Anita K. Protection Mechanisms and The Enforcement of Security Policies, pp. 228-251, Carnegie-Mellon University, Pittsburgh, PA, (1978).
Jueneman, R.R. et al. 'Message Authentication', pp. 29-40, IEEE Communications Magazine, vol. 23, No. 9, Sep. 1985.
Kahn, Robert E. The Organization of Computer Resources Into a Packet Radio Network, pp. 177-186, National Computer Conference, (1975).
Keeloq.RTM. Code Hopping Decoder, HCS500, 1997 Microchip Technology, Inc., 1-25.
Keeloq.RTM. Code Hopping Encoder, HCS300, 1996 Microchip Technology, Inc., 1-20.
Keeloq.RTM. NTQ 105 Code Hopping Encoder, pp. 1-8, Nanoteq (Pty.) Ltd., (Jul. 1993).
Keeloq.RTM. NTQ 125D Code Hopping Decoder, pp. 1-9, Nanoteq (pty.) Ltd., (Jul. 1993).
Kent, Stephen T. A Comparison of Some Aspects of Public-Key and Conventional Cryptosystems, pp. 4.3.1-4.3.5, ICC '79 Int. Conf. on Communications, Boston, MA, (Jun. 1979).
Kent, Stephen T. Comments on 'Security Problems in the TCP/IP Protocol Suite', pp. 10-19, Computer Communication Review, vol. 19, Part 3, (Jul. 1989).
Kent, Stephen T. Encryption-Based Protection Protocols for Interactive User-Computer Communication, pp. 1-121, (May 1976). (See pp. 50-53).
Kent, Stephen T. Protocol Design Consideration for Network Security, pp. 239-259, Proc. NATO Advanced Study Institute on Interlinking of Computer Networks, (1979).
Kent, Stephen T. Security Requirements and Protocols for a Broadcast Scenario, pp. 778-786, IEEE Transactions on Communications, vol. com-29, No. 6, (Jun. 1981).
Kent, Stephen T., et al. Personal Authorization System for Access Control to the Defense Data Network, pp. 89-93, Conf. Record of Eascon 82 15.sup.th Ann Electronics & Aerospace Systems Conf., Washington, D.C. (Sep. 1982).
Konheim, A.G. Cryptography: A Primer, pp. 285-347, New York, (John Wiley, 1981).
Koren, Israel, "Computer Arithmetic Algorithms" Prentice Hall, 1978, pp. 1-15.
Kruh, Louis. Device anc Machines: The Hagelin Cryptographer, Type C-52, pp. 78-82, Cryptologia, vol. 3, No. 2, (Apr. 1979).
Kruh, Louis. How to Use the German Enigma Cipher Machine: A photographic Essay, pp. 291-296, Cryptologia, vol. No. 7, No. 4 (Oct. 1983).
Kuhn, G.J., et al. A Versatile High-Speed Encryption Chip, Infosec '90 Symposium, Pretoria, (Mar. 16, 1990).
Kuhn. G.J. Algorithms for Self-Synchronizing Ciphers, pp. 159-164, Comsig 88, University of Pretoria, Pretoria, (1988).
Lamport, Leslie. The Synchronization of Independent Processes, pp. 15-34, Acta Informatica, vol. 7, (1976).
Linn, John and Kent, Stephen T. Electronic Mail Privacy Enhancement, pp. 40-43, American Institute of Aeronautics and Astronautics, Inc. (1986).
Lloyd, Sheelagh. Counting Functions Satisfying a Higher Order Strict Avalanche Criterion, pp. 63-74, (1990).
Marneweck, Kobus. Guidelines for KeeLoq.RTM. Secure Learning Implementation, TB007, pp. 1-5, 1987 Microchip Technology, Inc.
Massey, James L. The Difficulty with Difficulty, pp. 1-4, Jul. 17, 1996. http://www.iacr.org/conferences/ec96/massey/html/framemassey.html.
McIvor, Robert. Smart Cards, pp. 152-159, Scientific American, vol. 253, No. 5, (Nov. 1985).
Meier, Willi. Fast Correlations Attacks on Stream Ciphers (Extended Abstract), pp. 301-314, Eurocrypt 88, IEEE, (1988).
Meyer, Carl H. and Matyas Stephen H. Cryptography: A New Dimension in Computer Data Security, pp. 237-249 (1982).
Michener, J.R. The 'Generalized Rotor' Cryptographic Operator and Some of Its Applications, pp. 97-113, Cryptologia, vol. 9, No. 2, (Apr. 1985).
Microchip Technology, Inc., Enhanced Flash Microcontrollers with 10-Bit A/D and nano Watt Technology, PIC18F2525/2620/4525/4620 Data Sheet, 28/40/44-Pin, .Copyrgt.2008.
MM57HS01 HiSeC.TM. Fixed and Rolling Code Decoder, National Semiconductor, Nov. 11, 1994, 1-8.
Morris, Robert. The Hagelin Cipher Machine (M-209): Reconstruction of the Internal Settings, pp. 267-289, Cryptologia, 2(3), (Jul. 1978).
Newman, David B., Jr., et al. 'Public Key Management for Network Security', pp. 11-16, IEE Network Magazine, 1987.
Nickels, Hamilton, 'Secrets of Making and Breading Codes' Paladin Press, 1990, pp. 11-29.
Niederreiter, Harald. Keystream Sequences with a Good Linear Complexity Profile for Every Starting Point, pp. 523-532, Proceedings of Eurocrypt 89, (1989).
Nirdhar Khazanie and Yossi Matias, Growing Eddystone with Ephemeral Identifiers: A Privacy Aware & Secure Open Beacon Format; Google Developers; Thursday, Apr. 14, 2016; 6 pages.
NM95HSO1/NM95HSO2 HiSeC.TM. (High Security Code) Generator, pp. 1-19, National Semiconductor, (Jan. 1995).
Otway, Dave and Rees, Owen. Efficient and timely mutual authentication, ACM Sigops Operating Systems Review, vol. 21, Issue 1, Jan. 8-10, 1987.
Peebles, Jr., Peyton Z. and Giuma, Tayeb A.; "Principles of Electrical Engineering" McGraw Hill, Inc., 1991, pp. 562-597.
Peyret, Patrice, et al. Smart Cards Provide Very High Security and Flexibility in Subscribers Management, pp. 744-752, IEE Transactions on Consumer Electronics, 36(3), (Aug. 1990).
Postel, J. ed. 'DOD Standard Transmission Control Protocol', pp. 52-133, Jan. 1980.
Postel, Jonathon B., et al. The ARPA Internet Protocol, pp. 261-271, (1981).
Reed, David P. and Kanodia, Rajendra K. Synchronization with Eventcounts and Sequencers, pp. 115-123, Communications of the ACM, vol. 22, No. 2, (Feb. 1979).
Reynolds, J. and Postel, J. Official ARPA—Internet Protocols, Network Working Groups, (Apr. 1985).
Roden, Martin S., "Analog and Digital Communication Systems," Third Edition, Prentice Hall, 1979, pp. 282-460.
Ruffell, J. Battery Low Indicator, p. 15-165, Eleckton Electronics, (Mar. 1989). (See p. 59).
Saab Anti-Theft System: 'Saab's Engine Immobilizing Anti-Theft System is a Road-Block for 'Code-Grabbing' Thieves', pp. 1-2, Aug. 1996; http://www.saabusa.com/news/newsindex/alarm.html.
Savage. J.E. Some Simple Self-Synchronizing Digital Data Scramblers, pp. 449-498, The Bell System Tech. Journal, (Feb. 1967).
Seberry, J. and Pieprzyk, Cryptography—An Introduction to Computer Security, Prentice Hall of Australia, YTY Ltd, 1989, pp. 134-136.
Secure Terminal Interface Module for Smart Card Application, pp. 1488-1489, IBM: Technical Disclosure Bulletin, vol. 28, No. 4, (Sep. 1985).

(56) References Cited

OTHER PUBLICATIONS

Shamir, Adi. 'Embedding Cryptographic Trapdoors in Arbitrary Knapsack Systems', pp. 77-79, Information Processing Letters, 1983.
Shamir, Adi. Embedding cryptographic Trapdoors in Arbitrary Knapsak Systems, pp. 81-85, IEEE Transactions on Computers, vol. C-34, No. 1, (Jan. 1985).
Siegenthaler, T. Decrypting a Class of Stream Ciphers Using Ciphertext Only, pp. 81-85, IEEE Transactions on Computers, vol. C-34, No. 1, (Jan. 1985).
Simmons, Gustavus, J. Message Authentication with Arbitration of Transmitter/Receiver Disputes, pp. 151-165 (1987).
Smith, J.L., et al. An Experimental Application of Crptography to a Remotely Accessed Data System, pp. 282-297, Proceedings of hte ACM, (Aug. 1972).
Smith, Jack, 'Modem Communication Circuits.' McGraw-Hill Book Company, 1986, Chapter 11, pp. 420-454.
Smith, Jack, 'Modem Communication Circuits' McGraw-Hill Book Company, 1986, Chapter 7, pp. 231-294.
Smith. J.L. The Design of Lucifer: a Cryptographic Device for Data Communications, pp. 1-65, (Apr. 15, 1971).
Soete, M. Some constructions for authentication—secrecy codes, Advances in Cryptology—Eurocrypt '88, Lecture Notes in Computer Science 303 (1988), 57-75.
SpotHero, Frequently Asked Questions, Wayback Machine capture dated Jun. 30, 2017, 3 pages, retrieved from https://web.archive.org/web/20170630063148/https://spothero.com/faq/.
Steven Dawson, Keeloq.RTM. Code Hopping Decoder Using Secure Learn, AN662, 1997 Microchip Technology, Inc., 1-16.
Summary of Spothero Product, publicly available before Aug. 1, 2018.
Svigals, J. Limiting Access to Data in an Indentification Card Having a Micro-Processor, pp. 580-581, IBM: Technical Disclosre Bulletin, vol. 27, No. 1B, (Jun. 1984).
Thatcham: The Motor Insurance Repair Research Centre, The British Insurance Industry's Criteria for Vehicle Security (Jan. 1993) (Lear 18968-19027), pp. 1-36.
Transaction Completion Code Based on Digital Signatures, pp. 1109-1122, IBM: Technical Disclosure Bulletin, vol. 28, No. 3, (Aug. 1985).
Turn, Rein. Privacy Transformations for Databank Systems, pp. 589-601, National Computer Conference, (1973).
U.S. Appl. No. 16/528,376; Advisory Action dated May 4, 2021; 4 pages.
Uber, Airbnb and consequences of the sharing economy: Research roundup, Harvard Kennedy School—Shorenstein Center on Media, Politics, and Public Policy, 14 pages, Jun. 3, 2016, retrieved from https://journalistsresource.org/studies/economics/business/airbnb-lyft-uber-bike-share-sharing-economy-research-roundup/.
USPTO; U.S. Appl. No. 16/454,978; Notice of Allowance dated Feb. 16, 2021.
USPTO; U.S. Appl. No. 16/454,978, filed Jun. 27, 2019; 57 pages.
USPTO; U.S. Appl. No. 16/454,978; Office Action dated May 8, 2020; 25 pages.
USPTO; U.S. Appl. No. 16/454,978; Office Action dated Sep. 22, 2020; 36 pages.
USPTO; U.S. Appl. No. 16/528,376; Office Action dated Feb. 17, 2021; (pp. 1-14).
USPTO; U.S. Appl. No. 16/528,376; Office Action dated Aug. 18, 2020, (pp. 1-11).
USPTO; U.S. Appl. No. 16/528,376; Office Action dated Aug. 18, 2020; 34 Pages.
Voydock, Victor L. and Kent, Stephen T. 'Security in High-Level Network Protocols', IEEE Communications Magazine, pp. 12-25, vol. 23, No. 7, Jul. 1985.
Voydock, Victor L. and Kent, Stephen T. 'Security Mechanisms in High-Level Network Protocols', Computing Surveys, pp. 135-171, vol. 15, No. 2, Jun. 1983.
Voydock, Victor L. and Kent, Stephen T. Security Mechanisms in a Transport Layer Protocol, pp. 325-341, Computers & Security, (1985).
Watts, Charles and Harper John. How to Design a HiSec.TM. Transmitter, pp. 1-4, National Semiconductor, (Oct. 1994).
Weinstein, S.B. Smart Credit Cards: The Answer to Cashless Shopping, pp. 43-49, IEEE Spectrum, (Feb. 1984).
Weissman, C. Securtiy Controls in the ADEPT-50 Time-Sharing Syustem, pp. 119-133, AFIPS Full Joint Compuer Conference, (1969).
Welsh, Dominic, Codes and Cryptography, pp. 7.0-7.1, (Clarendon Press, 1988).
Wolfe, James Raymond, "Secret Writing—The Craft of the Cryptographer" McGraw-Hill Book Company 1970, pp. 111-122, Chapter 10.
YouTube Video entitled "How to Set up Tesla Model 3 Homelink . . . Super Easy!!!!" https://www.youtube.com/watch?v=nmmy4i7FO5M; published Mar. 1, 2018.
YouTube Video entitled Tesla Model X Auto Park in Garage (Just Crazy), https://youtu.be/BszlChMuZV4, published Oct. 2, 2016.
USPTO; U.S. Appl. No. 16/528,376; Non-Final Rejection dated Jan. 19, 2022; (pp. 1-12).
USPTO; U.S. Appl. No. 16/871,844; Notice of Allowance dated Feb. 23, 2021; (pp. 1-6).
USPTO; U.S. Appl. No. 16/528,376; Notice of Allowance and Fees Due (PTOL-85) dated Jul. 6, 2022; (pp. 1-3).
USPTO; U.S. Appl. No. 16/528,376; Notice of Allowance and Fees Due (PTOL-85) dated Jul. 20, 2022; (pp. 1-3).
PCT Patent Application No. PCT/US2021/064227; International Search Report and The Written Opinion; dated May 12, 2022; 12 Pages.
USPTO: U.S. Appl. No. 16/528,376; Notice of Allowance and Fees Due (PTOL-85) dated Jun. 14, 2022; (pp. 1-8).

* cited by examiner

IN-VEHICLE TRANSMITTER TRAINING

CROSS-REFERENCE TO RELATED APPLICATIONS

This is a continuation of U.S. patent application Ser. No. 16/871,844, filed May 11, 2020, entitled IN-VEHICLE TRANSMITTER TRAINING, which application claims the benefit of U.S. Provisional application No. 62/848,764, filed May 16, 2019, entitled IN-VEHICLE TRANSMITTER TRAINING, which is incorporated by reference in its entirety herein.

TECHNICAL FIELD

This disclosure relates generally to transmitters for controlling appliances and, in particular, to an in-vehicle transmitter operably coupled to a human-machine interface for controlling the in-vehicle transmitter.

BACKGROUND

An increasing number of vehicles sold today include universal transmitters built into the vehicle that allow a driver or vehicle passenger to control devices such as a garage door opener regardless of the manufacturer of the opener. Users control such transmitters via a human machine interface (HMI) or a user interface integral or unitary to the vehicle. Universal transmitters are configured to control a particular garage door opener or other external device based on some training or set up operations performed by the user. Users engage the user interface to perform the training or configuration of the universal transmitter. Many times, the user refers to additional resources including instructional videos, online tutorials, and paper instructions such as the vehicle's owner manual to facilitate the set-up process.

Other automotive trends include the increasing use of touch screens as the primary interface for the vehicle. These touch screen interface units, typically located in the dashboard of the vehicle and called "center stack" units, are used to control various features and functions of the vehicle, for example, a built-in universal transmitter, navigation, infotainment, telematics, audio devices, climate control, and the like. The center stack communicates with an in-vehicle computing device to facilitate these features and functions. With the number of features available on the center stack, setting up the different features presents an increasing effort on the part of the vehicle user, especially upon first acquiring the vehicle.

BRIEF DESCRIPTION OF THE DRAWINGS

The in-vehicle transmitter training is set forth in the following detailed description, particularly in conjunction with the drawings, wherein.

Figure 1A:
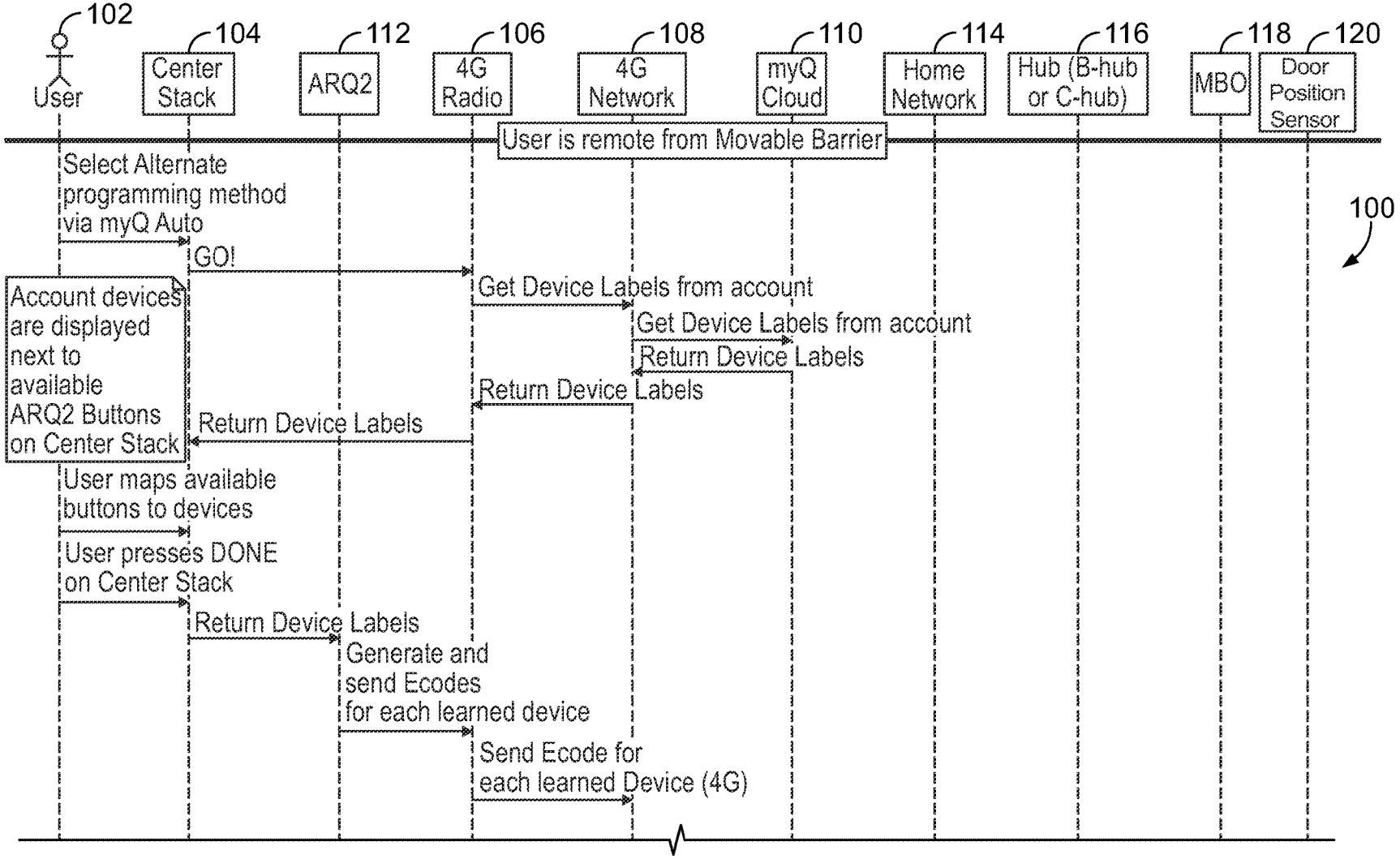
FIGS. 1A and 1B comprise a flow diagram showing example communications among several elements of a vehicle, network, and a movable barrier operator system.
Figure 1A:
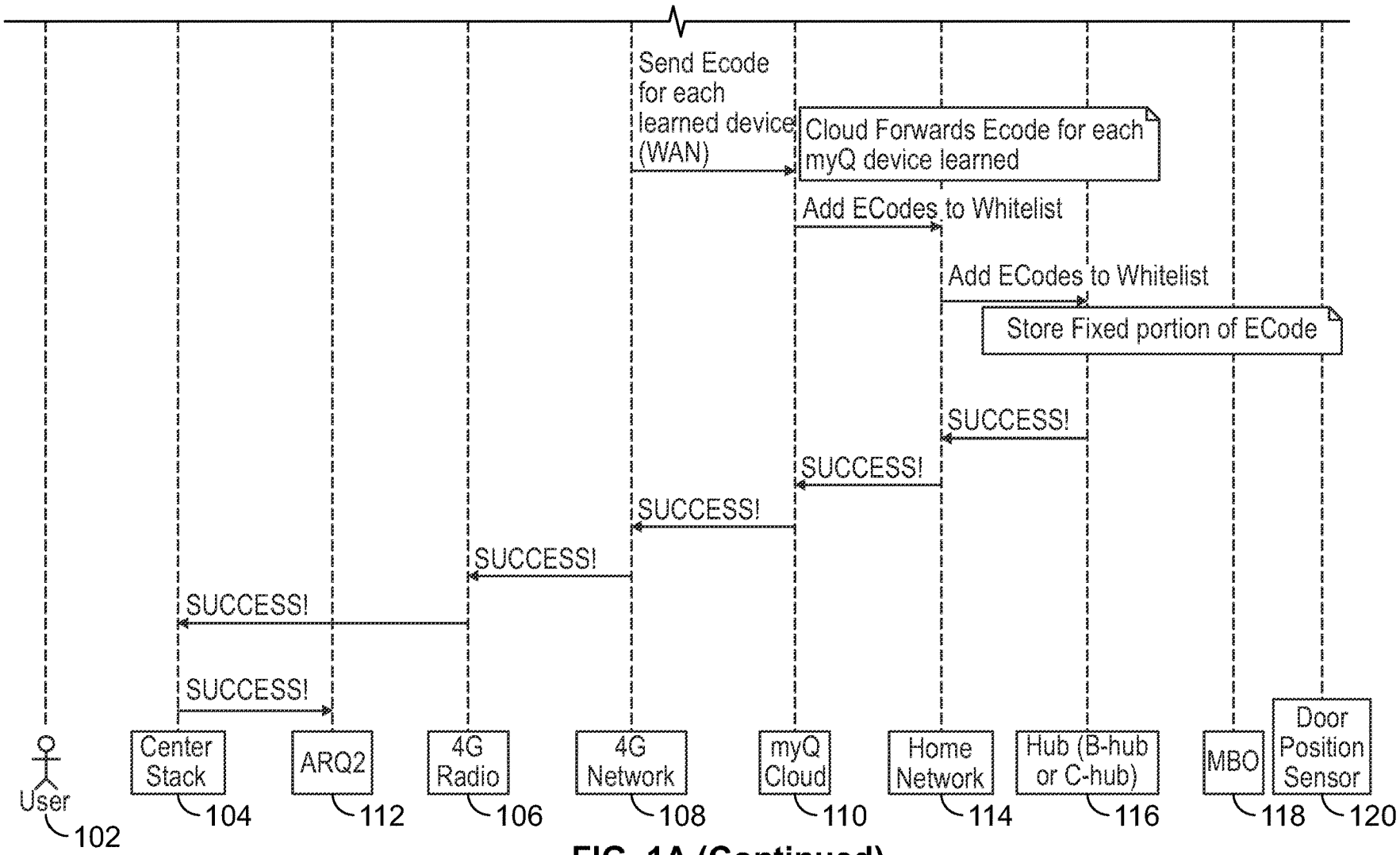

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, an in-vehicle or center stack control system can be used to facilitate training of a vehicle mounted universal transmitter in a way that allows a user to forego use of supplemental/additional resources such as paper-based or electronic-based tutorials, videos or instructions. In certain approaches, an internet connection is not needed to allow the user to set up the transmitter to control a movable barrier operator or other controllable device, such as a light or door lock.

In one aspect of the present disclosure, an in-vehicle apparatus is provided that includes a transmitter operable to transmit radio frequency control signals, and communication circuitry configured to communicate with a remote computer via a network. The communication circuitry is configured to receive information from the remote computer via the network, the information pertaining to one or more controllable devices including a movable barrier operator system associated with a user account. The controllable devices may include, for example, a light, a lock, and/or a security system of a home. The in-vehicle apparatus includes a user interface configured to receive a user input requesting control of the movable barrier operator system and a processor operably coupled to the transmitter, communication circuitry, and user interface.

The processor is configured to communicate with the remote computer, via the communication circuitry, a transmitter identifier representative of a transmitter code of the transmitter. The communication may involve the communication circuitry communicating the transmitter identifier to the remote computer. For example, the transmitter identifier may include a hash of a fixed code of the transmitter and the processor causes the communication circuitry to communicate the hash of the fixed code to the remote computer. As another example, the communication may involve the communication circuitry receiving the transmitter identifier from the remote computer. For example, the transmitter identifier may include encoded information that is decoded by the processor and used by the processor to set the transmitter code, such as a one-time-use passcode.

The processor is configured to effect the movable barrier operator to change a state of a movable barrier (e.g., a garage door) by causing the transmitter to transmit a first radio frequency control signal to the movable barrier operator system, wherein the first radio frequency control signal includes the transmitter code. The processor is further configured to effect the movable barrier operator to learn the transmitter by causing the transmitter to transmit a second radio frequency control signal to the movable barrier operator system. In this manner, the in-vehicle apparatus may cause the movable barrier operator to change the state of the movable barrier via the first radio frequency control signal and may cause the movable barrier operator to learn the transmitter via the second radio frequency control signal.

In one embodiment, the processor is configured to cause the transmitter to transmit the first radio frequency control signal at a first frequency and transmit the second radio frequency control signal at a second frequency different than the first frequency. For example, the first frequency may be in the range of approximately 300 MHz to approximately 400 MHz and the second frequency may be in the range of approximately 900 MHz to approximately 1 GHz. The different frequencies of the first and second radio frequency control signals may facilitate the movable barrier operator identifying the first radio frequency control signal including the transmitter code and changing the state of the movable barrier.

In another aspect of the present disclosure, a movable barrier operator system is provided that includes a motor and communication circuitry configured to receive an add transmitter request from a remote computer via a network, the add transmitter request including a transmitter identifier. The communication circuitry is configured to receive a first radio frequency control signal and a second radio frequency control signal from an unknown in-vehicle transmitter, wherein the first radio frequency control signal includes a transmitter code. The movable barrier operator system includes processor circuitry configured to cause the motor to change a state of the movable barrier upon the transmitter code of the first radio frequency control signal corresponding to the transmitter identifier. The processor circuitry is further configured to learn the unknown in-vehicle transmitter in response to the communication circuitry receiving the second radio frequency control signal.

For example, the transmitter code may include a fixed code of the unknown in-vehicle transmitter and the transmitter identifier may include a hash of the fixed code. The processor may perform a hash function on the fixed code hash to determine the fixed code. The processor circuitry may determine that the transmitter code corresponds to the transmitter identifier if the fixed code determined using the hash function matches the fixed code of the first radio frequency control signal. In another approach, the processor circuitry may determine that the transmitter code corresponds to the transmitter identifier if the similarity of the transmitter code and the transmitter identifier is greater than a threshold.

Figure 1B:
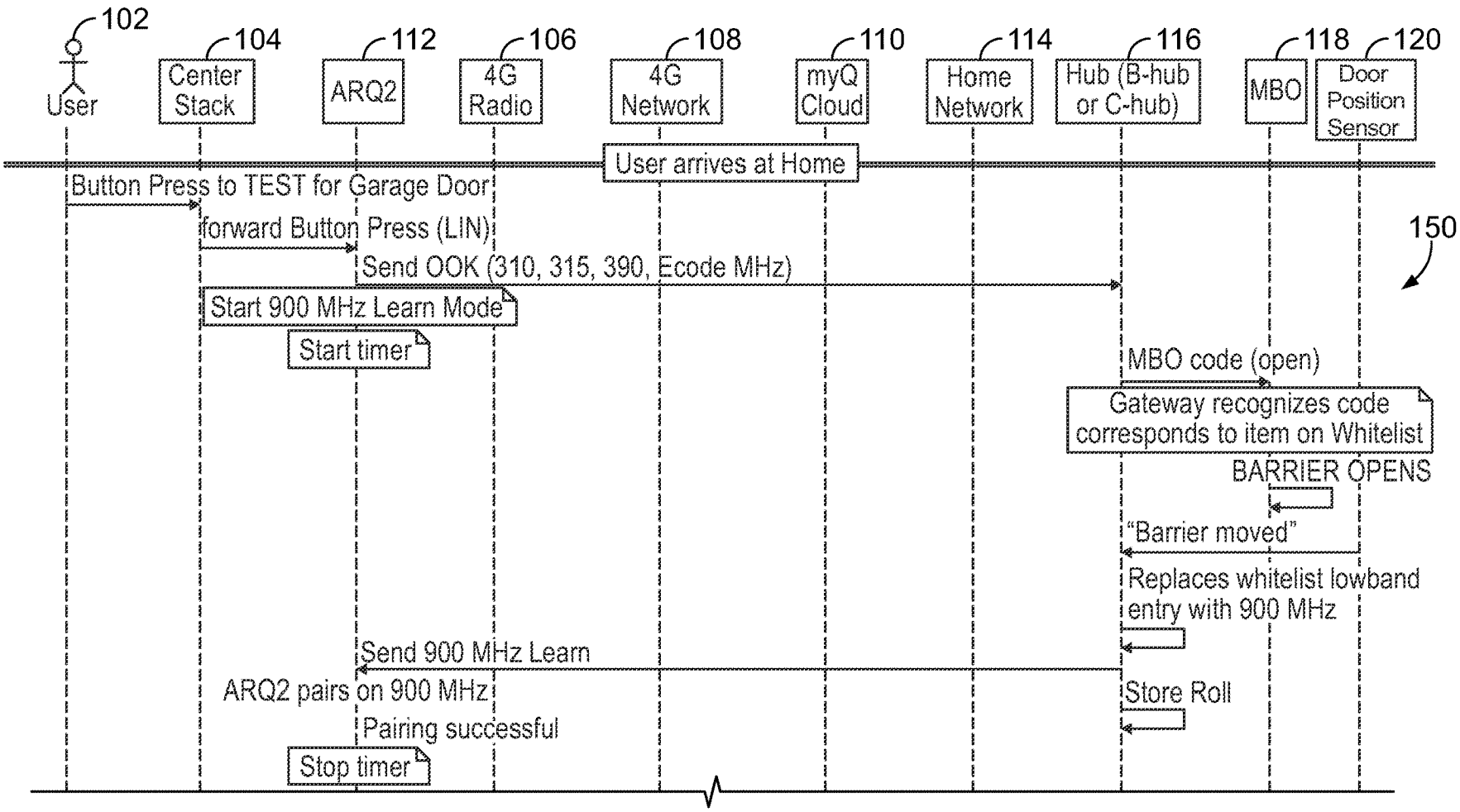
Figure 1B:
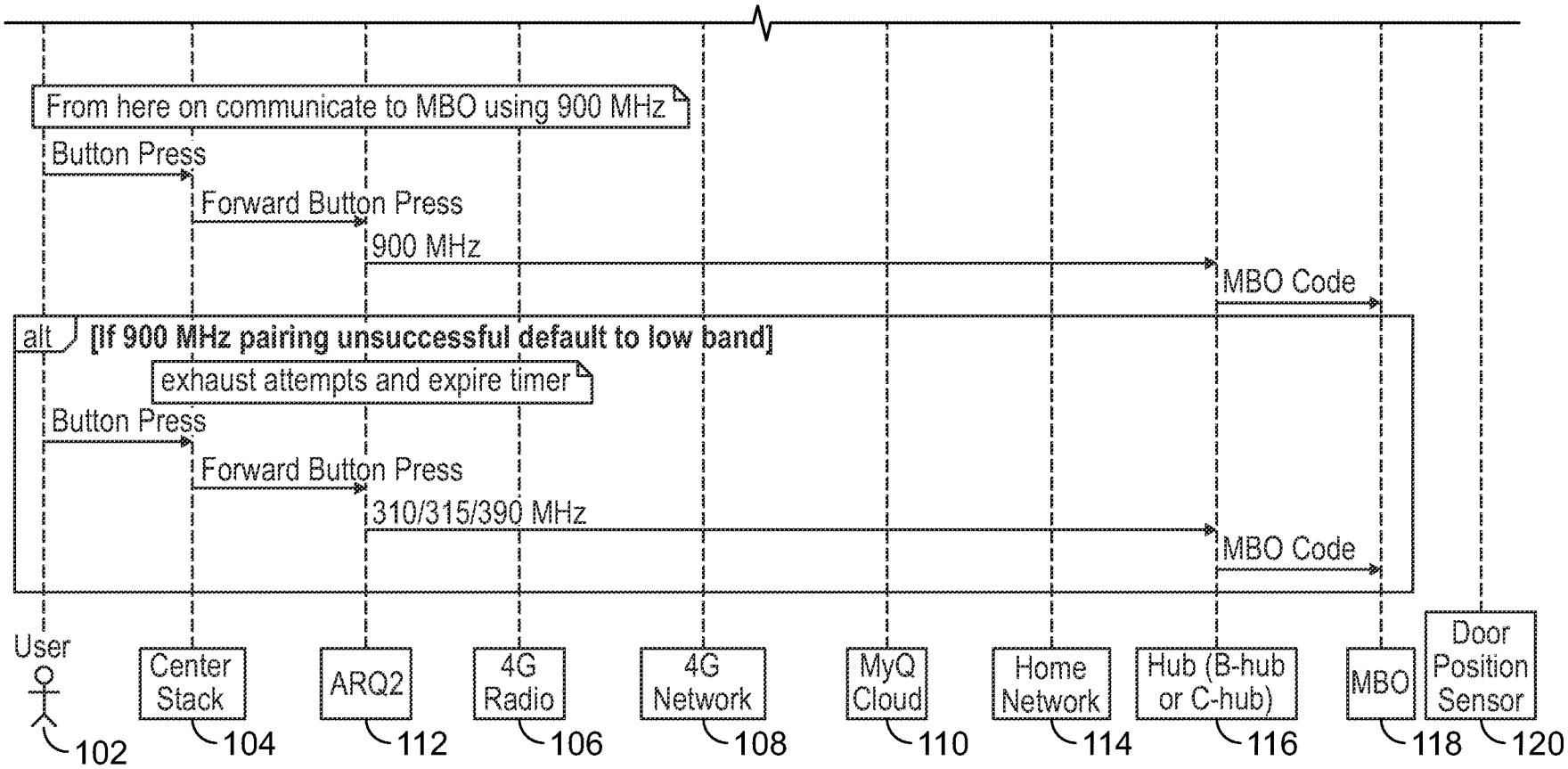

Referring now to the drawings, and in particular to FIG. 1 constituted by FIGS. 1A and 1B, an illustrative process 100 that is compatible with many of these teachings will now be presented. A user 102 selects a programming method via a software-based application (or "app") in a user interface such as the center stack 104. The center stack 104 communicates with the vehicle's computing system to activate or open a network connection between the vehicle and a wide-area network such as the Internet. In the example of FIG. 1A, this connection includes a 4G radio 106 disposed in the vehicle that communicates with a 4G network 108, thereby providing access to the Internet. In other examples, other technologies and/or wide area networks (e.g., Long Term Evolution (LTE), 5G/NR, etc.) available to allow an Internet connection for the vehicle may be used. As illustrated, the 4G radio 106 in the vehicle communicates with a 4G network 108 to connect to a remote computer 110, such as a cloud based computing system or middleware, executing a server or service associated with the software client app in the vehicle, here labeled the "myQ cloud." If the user is using the software client app for the first time, the user may login to the cloud based account via the client app on the center stack 104. This login will then request labels (e.g., human-readable names or identifiers) of devices associated with the user's account that are stored in the cloud-based account. In response to this request, the cloud-based account will return the device labels through the 4G network 108 to the 4G radio 106 in the vehicle, which then will present or otherwise display the returned device labels on the center stack 104. In this example, the user may then map the device labels to particular virtual or physical buttons or other user interface features in the vehicle or in the center stack 104.

In certain examples, software available on the center stack 104 or in a transmitter, such as universal transmitter 112 shown as "ARQ2," mounted in the car may generate codes for each or a set of the devices having labels mapped thereto. The codes are generated independently of the labels downloaded from the cloud based system 110. The codes can be used to facilitate pairing of the transmitter 112 and the mapped devices upon arrival of the vehicle at the home. As illustrated in FIG. 1A, the vehicle based universal transmitter 112 labeled ARQ2 generates and sends these codes called Ecodes to the cloud-based system (labeled myQ Cloud) via the vehicle's 4G radio 106 and the Internet connected 4G network 108. The cloud based system 110 in turn delivers the Ecodes via the Internet to the home based or local network 114 (although the network may be instantiated at any physical location, not necessarily a home), which is operatively connected to a hub device 116 (or optionally the end device itself such as the movable barrier operator, light, lock, and the like). The hub device 116 (or end device) stores the code for later pairing with the transmitter device 112. Optionally, the hub device 116 may send a success acknowledgement through the home network 114, cloud-based system 110, and 4G internet connection 108 to the vehicle-based radio for receipt by the vehicle center stack software app and the vehicle based universal transmitter 112, which may acknowledge this receipt in the user display of the center stack 104.

Turning to FIG. 1B, an example method 150 for completing the learning of the universal transmitter 112 to the home-based device is shown. When the user 102 arrives at home with the vehicle, the user may select one of the previously mapped buttons or user interface elements such as a touch element of the center stack 104 to attempt to operate the associated home-based device. In the illustrated example, user presses the button for operating the movable barrier operator (MBO) 118 on the center stack 104. The center stack 104 receives the button press, and signals to the universal transmitter 112 to send a code signal to the receiving device in the home, here illustrated as the hub device 116 (or, as discussed with reference to FIG. 1A, optionally the end device itself such as the movable barrier operator 118, light, lock, and the like). In this example, the signal sent by the universal transmitter 112 is in the range of a 300 MHz-400 MHz frequency signal as is customary for certain movable barrier operators, such as garage door openers. The hub device 116 compares this signal (sent from the universal transmitter 112 and received by hub device 116) to the previously received Ecode signal to determine whether the signal received from the universal transmitter 112 corresponds to the previously received Ecode (see FIG. 1A—operations of: Generate and send Ecodes for each learned device; Send Ecode for each learned device (4G); Cloud forwards Ecode for each myQ device learned; and Add Ecodes to Whitelist). Based on this determination or comparison of the previously-received (indirectly via network) Ecode and the newly-received (transmitted 300 MHz-400 MHz) Ecode, the hub device 116 operates the movable barrier operator 118 if the comparison result is true (i.e., Ecodes substantially match or match in a relevant portion thereof) and sends an acknowledgement signal back to the universal transmitter 112. A door position sensor 120 may be used to detect when the position of the movable barrier changes. In the illustrated example, the system uses this exchange of signals to configure the universal transmitter 112 to operate in future activations in a 900 MHz-1 GHz transmission mode. Therefore, additional actuations by the user of the garage button in the center stack 104 cause the universal transmitter 112 to send associated signaling to the hub device 116 or movable barrier operator 118 using 900 MHz-1 GHz signaling. So configured, the system is able to pair the universal transmitter 112 with the home based device with minimal interaction by the user. Moreover, from the user's perspective, logging into the cloud based system on the vehicle center stack 104 before even reaching home appears to have configured the transmitter 112 for use with the home based devices. If the 900 MHZ-1 GHz signaling was unsuccessful in permitting the movable barrier operator 118 to learn the universal transmitter 112, the method 150 may include defaulting back to signals in the 300 MHz-400 MHz band to complete learning as shown in FIG. 1B.

Figure 2:
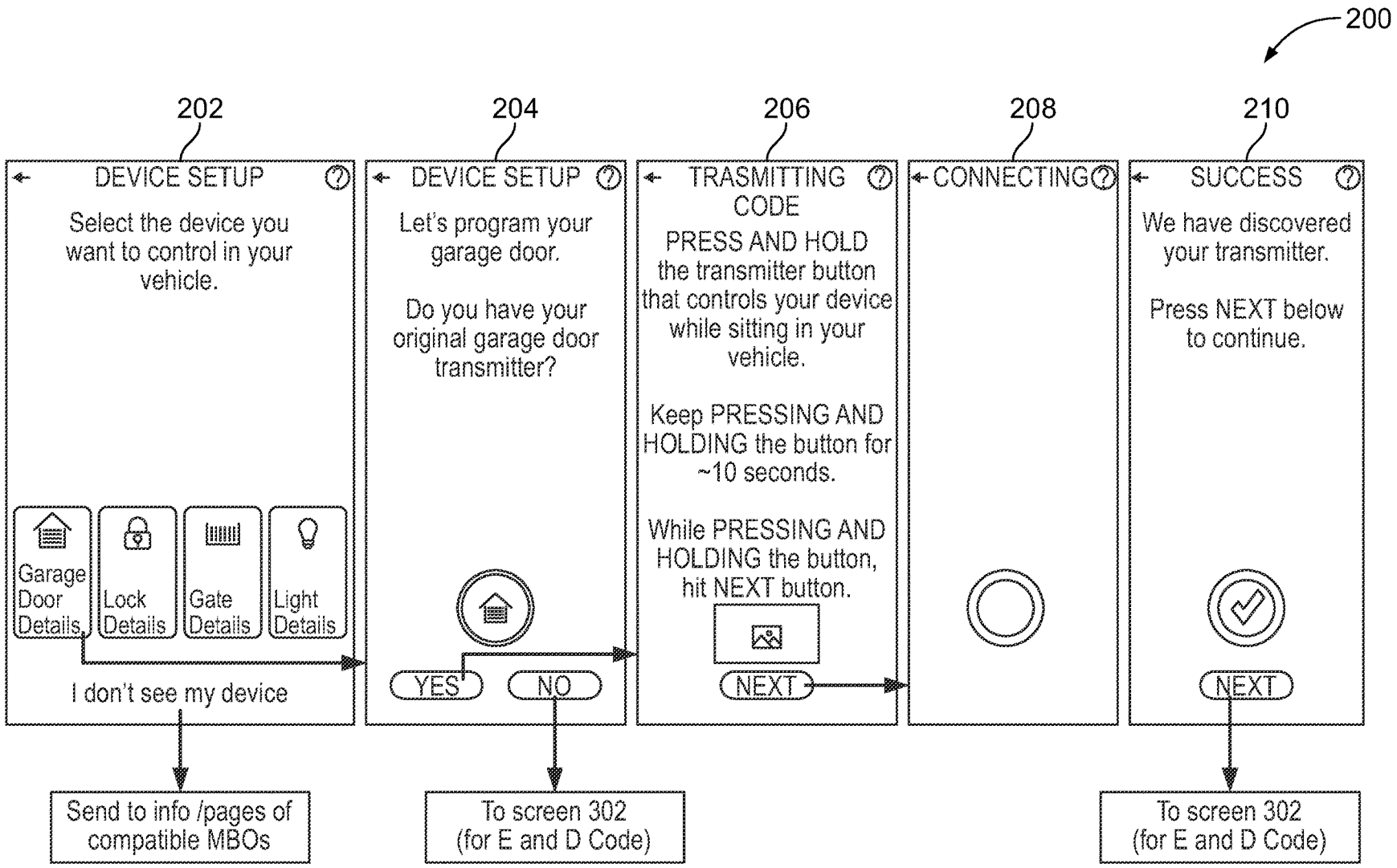
FIG. 2 comprises a series of example screens as may be displayed on a center stack display unit.

An example series of graphical user interface screens displayed to the user in setting up the universal transmitter 112 according to an illustrative process 200 is illustrated in FIG. 2. At screen 202 presentation of the list of devices (e.g., device labels) downloaded from the user's cloud-based account or as may be available for use with the universal transmitter 112 is shown. In this example, the user selects the movable barrier operator 118 for device setup. In response to this selection, screen 204 is displayed, which asks whether the user has the original movable barrier operator transmitter available to assist in training the universal transmitter 112 mounted within the vehicle. If yes, the center stack 104 will proceed through screens 206, 208, and 210 as illustrated in FIG. 2. In screen 206 the user is instructed to press and hold the button of the original movable barrier operator transmitter to allow for training the universal transmitter 112 mounted in the vehicle. The center stack 104 instruction guides the user through this process by including specific instructions in screen 206 for the user to follow. After pressing "next" on screen 206, the center stack 104 will display screen 208 to inform the user with respect to the connection process, eventually transitioning to screen 210 to indicate success in the universal transmitter's 112 receiving the signal from the original transmitter.

Figure 3:
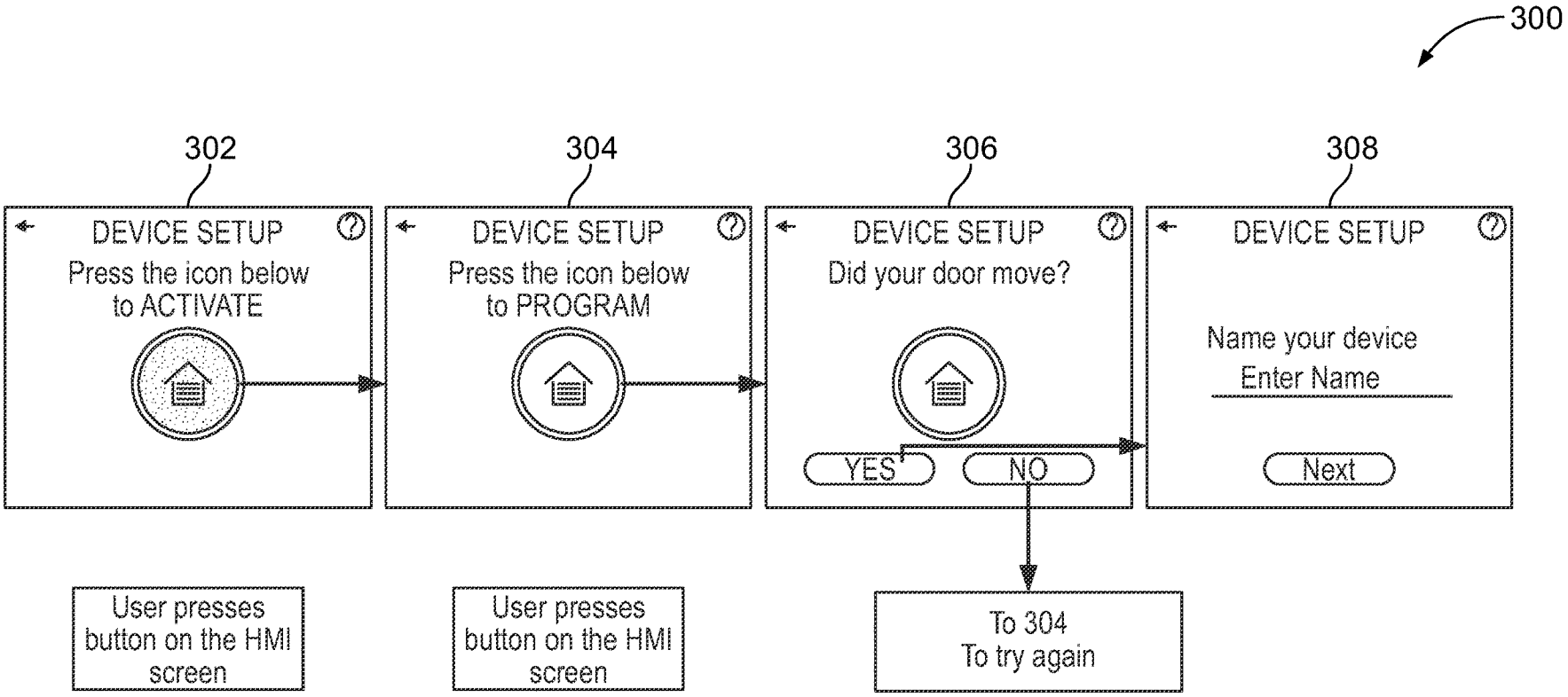
FIG. 3 comprises a series of example screens as may be displayed on a center stack display unit.

Turning to FIG. 3, an additional series of example graphical user interface screens displayed by the center stack 104 is illustrated. This sequence of screens will be displayed in connection with operating the movable barrier operator 118 according to an illustrative process 300, for example, when the user arrives home with a new vehicle having a universal transmitter 112 as described above with respect to FIG. 1. In this sequence, a garage icon is provided in screen 302 for the user to select (e.g., via a tap, press, long press, multi-point gesture, etc.) to trigger the universal transmitter 112 to transmit a signal to operate the movable barrier operator 118. In some situations, a second signal may be sent from the universal transmitter 112 to the universal movable barrier operator 118 to facilitate pairing of the transmitter 112 and the opener 118. In that situation, screen 304 provides another icon prompt for the user to select in order to trigger the universal transmitter 112 to send the additional signal. If this is the first time that the universal transmitter 112 has been used, screen 306 may be provided to allow the user to confirm whether the movable barrier (e.g., garage door) has been moved. If the movement was successful, the user may be prompted in screen 308 to provide an additional name or label for the movable barrier operator 118, especially if this is a new movable barrier operator as opposed to one that was associated with the label downloaded in accord with the process 100 described above with reference to FIG. 1. If the user instead indicates on screen 306 that the movable barrier did not move, an additional set up process may be initiated in response to the user feedback.

A different set of screens may be presented if interaction with the end device facilitates pairing the end device with the universal transmitter 112. For example, a screen can be presented to instruct the user to find and press a learn button or program button on the end device.

An additional series of screens may be used to step the user through the pairing process for certain types of end devices. For example, a series of garage icons is presented to prompt the user to press the respective icons, which in turn triggers the universal transmitter 112 to send various signaling to the end device as may be employed to train the universal transmitter 112 to operate with that end device. For example, a screen may prompt the user to press the garage icon, and a second screen prompts the user to press a second garage icon to facilitate programming between the universal transmitter 112 and the end device. A third screen prompts the user to press the garage icon again to test whether the pairing was successful. A fourth screen requests confirmation from the user as to whether the movable barrier moved as a result of this training process. If successful, a screen can be provided to allow the user to customize or provide a new name or label for the newly learned movable barrier operator 118.

Figure 4:
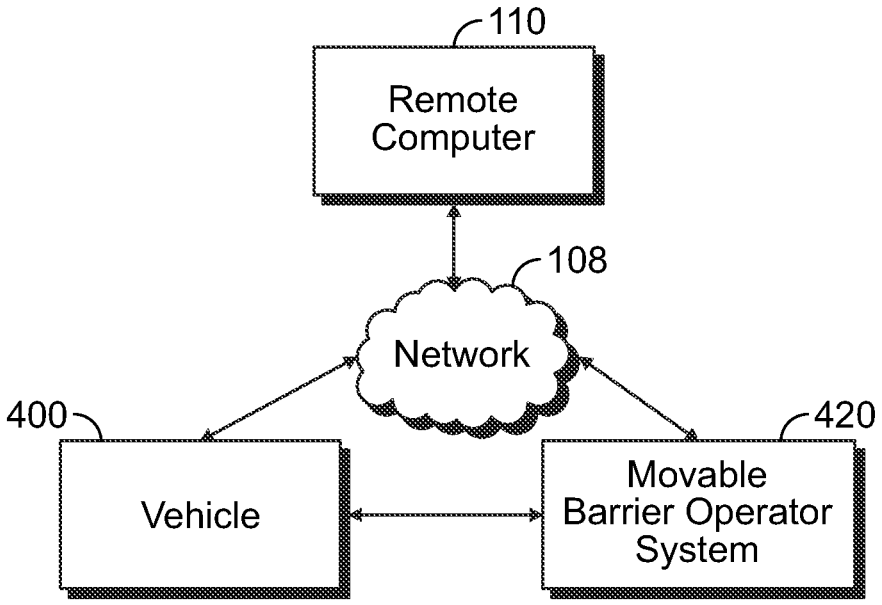
FIG. 4 is an example block diagram of the communication between the vehicle, network, and movable barrier operator system.

With reference now to FIG. 4, a vehicle 400 may be a "connected car" in communication with the remote computer 110 via the network 108, such as a 4G network or other long-range or wide-area wireless networks (e.g., LoRaWan, vehicle to anything (V2X), or WiMax networks and the internet). The remote computer 110 may include a server computer associated with a movable barrier operator system 420, for example, maintained and/or operated by a manufacturer of the movable barrier operator system 420. As discussed with regard to FIG. 1A, the vehicle 400 may communicate with remote computer 110 to receive a list of the controllable devices associated with a user account. The user may program the vehicle 400 to control one or more of the controllable devices associated with the user account via the universal transmitter 112. The vehicle 400 may communicate a transmitter identifier to the remote computer 110 for the remote computer 110 to send to the movable barrier operator system 420 for learning the universal transmitter 112 to the movable barrier operator system 420. The transmitter identifier code may include a code, token, or credential as some examples. The movable barrier operator system 420 may determine whether signals received include the transmitter identifier. If a signal is determined to include the transmitter identifier, the movable barrier operator system 420 may begin to learn the universal transmitter 112 to the movable barrier operator system 420. As one example, the transmitter identifier includes a fixed portion of code of the universal transmitter 112 that identifies the universal transmitter 112. The fixed portion of the code may be hashed or encrypted by the vehicle 400 or remote computer 110 before transmission across the network 108. The movable barrier operator system 420 may be configured to compare the hashed or encrypted code with the code received from the vehicle 400 to determine whether the codes correspond to one another.

The remote computer 110 may be in communication with the movable barrier operator system 420 via the network 108, e.g., the internet and a local Wi-Fi network. The remote computer 110 may be configured to control and/or monitor the status of the movable barrier operator system 420. For example, the remote computer 110 may communicate control signals to the movable barrier operator system 420 to change the state (e.g., open/close) of an associated movable barrier, e.g., a garage door.

The movable barrier operator system 420 may be configured to receive signals from the universal transmitter 112 of the vehicle 400, for example, radio frequency (RF) signals. The movable barrier operator system 420 may be configured to monitor for a signal that includes the transmitter identifier received from the vehicle 400 via the remote computer 110. To determine whether a signal includes the transmitter identifier, the movable barrier operator system 420 may compare a RF signal received to the transmitter identifier received from the remote computer 110. If a signal sufficiently corresponds to the transmitter identifier, the movable barrier operator system 420 may enter a learn mode or communicate with the universal transmitter 112 of the vehicle to learn the universal transmitter 112 to the movable barrier operator system 420.

Figure 5:
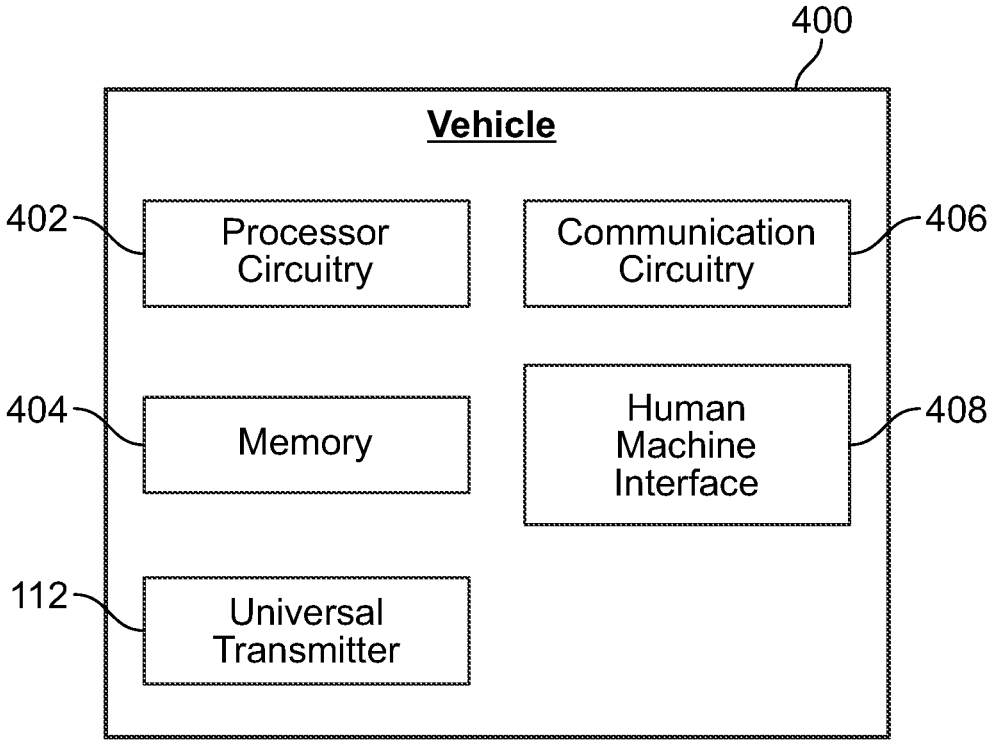
FIG. 5 is an example block diagram of the vehicle of FIG. 4.

Regarding FIG. 5, the vehicle 400 may include processor circuitry 402 and memory 404. The memory 404 may store programs and instructions for execution by the processor circuitry 402 to carry out the functionality of the vehicle 400 computer system. This may include, as examples, instantiating the vehicle navigation system and/or infotainment system. The processor circuitry 402 may communicate with remote devices via the communication circuitry 406. As an example, the communication circuitry 406 may facilitate communication between the processor circuitry 402 and devices on network 108, e.g., the remote computer 110. The communication circuitry 406 may be configured to communicate over one or more wireless communication protocols including, for example, wireless fidelity (Wi-Fi), cellular such as 3G, 4G, 4G LTE, 5G, radio frequency (RF), infrared (IR), Bluetooth (BT), Bluetooth Low Energy (BLE), Zigbee and near field communication (NFC). The processor circuitry 402 may also be configured to control the universal transmitter 112. The universal transmitter 112 may be configured to communicate via RF signals, e.g., the RF signals may be in the 300 MHz-400 MHz range, such as 310 MHz, 315 MHz, 390 MHz, and/or in the 900 MHz-1 GHz range, such as 900 MHz. The transmitter 112 may be configured as a transceiver to both send and receive RF signals.

The vehicle 400 may include a user interface such as a human machine interface 408. The human machine interface 408 may include a touchscreen display, such as a display of the center stack 104 or infotainment system of the vehicle 400. Additionally or alternatively, the human machine interface 408 may include an augmented reality display or heads-up display, button(s), a microphone, and/or speaker(s) 125 as examples. Upon receiving device labels from the cloud-based account, one or more aspects of the human machine interface 408 may be used to control the end devices of the cloud-based account. For example, the user may associate a physical or virtual button with a movable barrier operator 118 such that when the button is selected, a control signal is output for that movable barrier operator 118. As another example, the user may speak a command into a microphone of the vehicle 400, e.g., "Open left garage door," to cause the vehicle 400 to output a control signal for that movable barrier operator 118.

Figure 6:
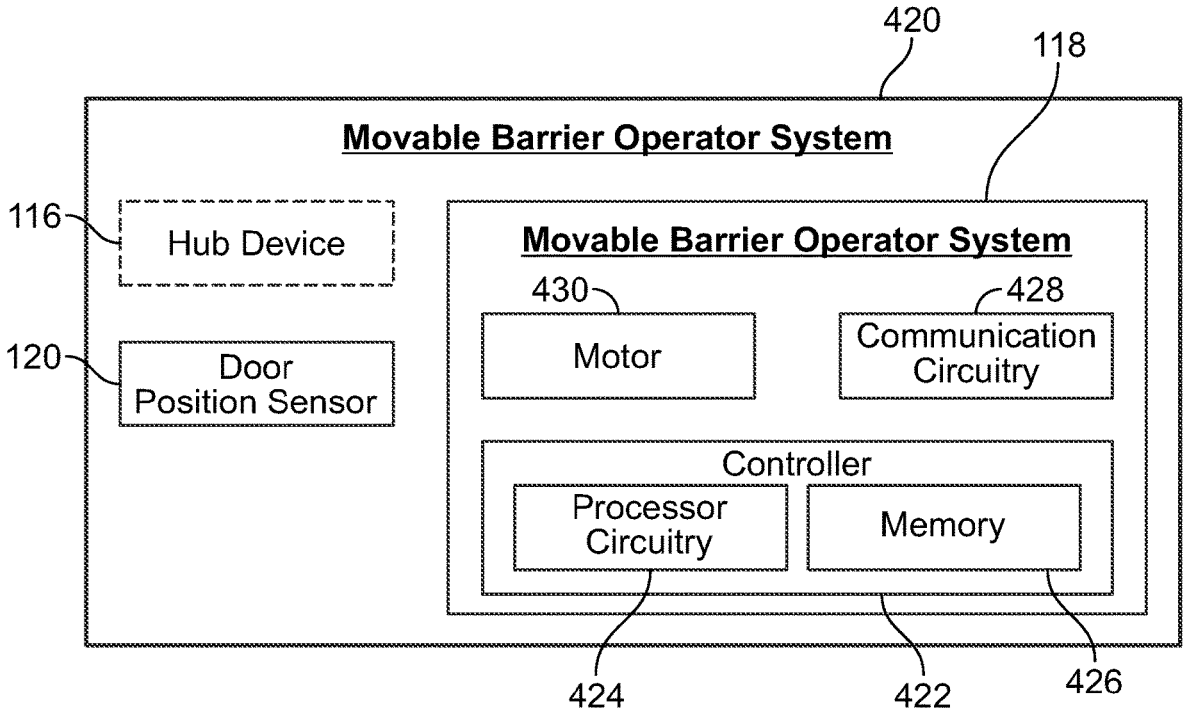
FIG. 6 is an example block diagram of the movable barrier operator system of FIG. 4.

Regarding FIG. 6, the movable barrier operator system 420 may include the movable barrier operator 118, the door position sensor 120, and a hub device 116. The movable barrier operator 118 includes a controller 422 that includes processor circuitry 424 and memory 426. The memory 426 is non-transitory computer readable media that may store programs and information. The memory 426 may store learned transmitters in a whitelist of transmitters. The movable barrier operator 118 may be actuated in response to receiving a control signal from a learned transmitter that has been stored in the whitelist. The whitelist may include a fixed code and a changing (e.g., rolling) code of learned transmitters. The memory 426 may store the transmitter identifier for comparison to signals received via the communication circuitry 428. The processor circuitry 424 may be configured to process signals received via the communication circuitry 428 to determine whether to change the state of the movable barrier or to learn a transmitter into the whitelist of transmitters in memory 426.

The controller 422 may be in communication with the communication circuitry 428. The communication circuitry 428 enables the movable barrier operator 118 to communicate with devices external to the movable barrier operator 118 directly and/or over network 402. The controller 422 may communicate with the remote computer 110 and the movable barrier operator system 420 via communication circuitry 428. The communication circuitry 428 may enable the movable barrier operator 118 to communicate over wireless protocols, for example, wireless fidelity (Wi-Fi), cellular, radio frequency (RF), infrared (IR), Bluetooth (BT), Bluetooth Low Energy (BLE), Zigbee and near field communication (NFC).

The controller 422 is configured to operate the motor 430. The controller 422 may operate the motor 430 in response to a state change request received via the communication circuitry 428 to operate the motor 430. The motor 430 may be coupled to the movable barrier to change the state of the movable barrier, i.e., move the movable barrier to an open, closed, or intermediate position. The controller 422 may also be in communication with a door position sensor 120. The door position sensor 120 may be used to monitor the state of the movable barrier, e.g., open, closed, or in between states. The door position sensor 120 may be as an example a tilt sensor. As another example, the door position sensor 120 may detect door position by monitoring movement of one or more components of a transmission of the movable barrier operator 118 such as via an optical encoder.

The movable barrier operator system 420 may optionally include a hub device 116. The hub device 116 may be used to facilitate communication between the movable barrier operator 118 and the network 108. The hub device 116 may be configured to communicate with the remote computer 110 via the network 108. The hub device 116 may send control commands to the movable barrier operator 118 to change the state of the movable barrier. The hub device 116 may be configured to communicate with the movable barrier operator 118 via a wired or wireless connection, e.g., via an RF signal. The hub device 116 may be configured to receive RF signals from the transmitter 112 of the vehicle 400. The hub device 116 may learn the transmitter 112 as described in relation to the movable barrier operator 118.

Figure 7:
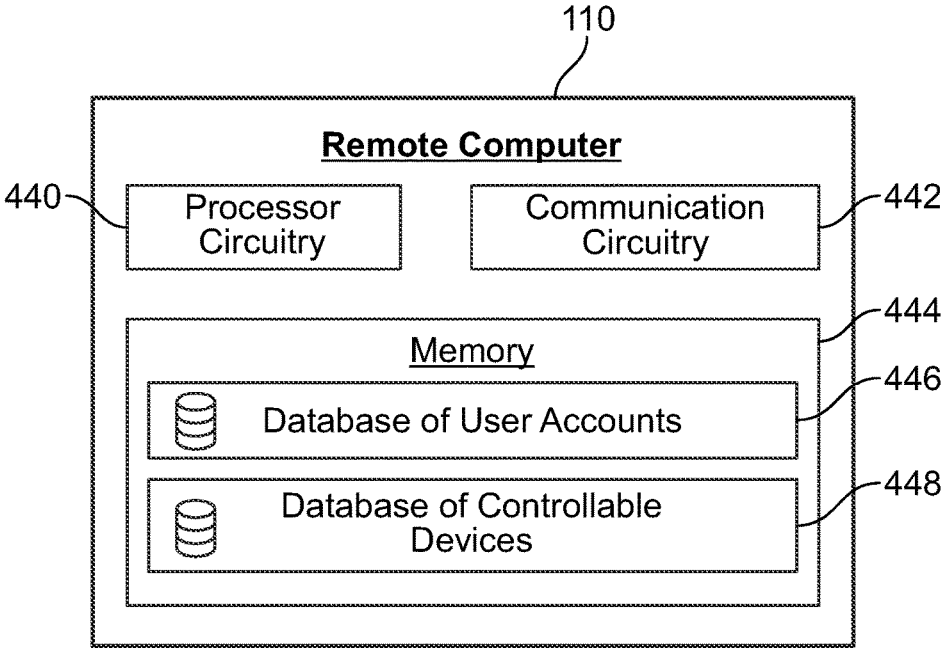
FIG. 7 is an example block diagram of a remote computer associated with the network of FIG. 4.

With reference to FIG. 7, the remote computer 110 includes processor circuitry 440 in operative communication with memory 444 and communication circuitry 442. The processor circuitry 440 may be configured to receive the transmitter identifier from the vehicle 400 and store the transmitter identifier in memory 444. The processor circuitry 440 may be configured to encrypt or hash all or a portion of the transmitter identifier. The processor circuitry 440 may send the transmitter identifier to the movable barrier operator system 420. The communication circuitry 442 enables the remote computer 110 to communicate with other devices over the network 108, for example the internet. Specifically, the communication circuitry 442 enables the remote computer 110 to send information to and receive information from the vehicle 400 and movable barrier operator system 420. The remote computer 110 may be associated with the movable barrier operator 118 and/or the hub device 116. As one example, the remote computer 110 is a server computer associated with a client application that is configured to control movable barrier operator 118. The client application may be instantiated in a user device such as the center stack 104, a smartphone, a wearable such as a smartwatch, tablet computer, and/or personal computer.

The memory 444 may include a database of user accounts 446. The user account may be an account that associates a user with one or more movable barrier operators and/or other controllable devices. The user account may be used to remotely control the movable barrier operator, for example, via a smartphone application. The memory 444 may also include a database of controllable devices 448 associated with the user accounts. The database of controllable devices 448 may be a list of devices such as movable barrier operators a user associates with their user account upon installation or for remote control. Upon a request from the vehicle 400 for controllable devices associated with a certain user account, the remote computer 110 may send the controllable devices in the database of movable barrier operator systems 448. The user may then select, within their vehicle, which of the controllable devices they wish to control with their vehicle.

Those skilled in the art will appreciate that the above-described processes may be implemented using any of a wide variety of available and/or readily configured platforms, including partially or wholly programmable platforms as are known in the art or dedicated purpose platforms as may be desired for some applications. Those skilled in the art will recognize and appreciate that such processor devices can comprise a fixed-purpose hard-wired platform or can comprise a partially or wholly programmable platform. All of these architectural options are well known and understood in the art and require no further description here.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, it will be appreciated that numerous changes and modifications will occur to those skilled in the art, and it is intended for the present invention to cover all those changes and modifications which fall within the scope of the appended claims.

What is claimed is:

1. A method of controlling a movable barrier operator system using an in-vehicle apparatus, the method comprising:

at the in-vehicle apparatus:

receiving information from a remote computer via a network, the information pertaining to one or more controllable devices including a movable barrier operator system associated with a user account;

receiving a user input requesting control of the movable barrier operator system;

communicating with the remote computer a transmitter identifier representative of a transmitter code of a transmitter of the in-vehicle apparatus;

transmitting a first radio frequency control signal to the movable barrier operator system to effect the movable barrier operator system to change a state of a movable barrier, the first radio frequency control signal including the transmitter code; and transmitting a second radio frequency control signal to the movable barrier operator system to effect the movable barrier operator system to learn the transmitter.

2. The method of claim 1 wherein transmitting the first radio frequency control signal includes transmitting the first radio frequency control signal at a first frequency, and wherein transmitting the second radio frequency control signal includes transmitting the second radio frequency control signal at a second frequency different than the first frequency.

3. The method of claim 2 wherein the first frequency is in the range of approximately 300 MHz to approximately 400 MHz; and wherein the second frequency is in the range of approximately 900 MHz to approximately 1 GHz.

4. The method of claim 1 further comprising communicating a credential of the user account to the remote computer via the network.

5. The method of claim 4 further comprising receiving the credential from a user.

6. The method of claim 1 wherein the transmitter code includes a fixed code of the transmitter; and wherein transmitting the second radio frequency control signal includes transmitting the fixed code and a changing code of the transmitter.

7. The method of claim 1 wherein communicating the transmitter identifier includes communicating a hash of the transmitter code with the remote computer.

8. The method of claim 1 wherein communicating with the remote computer includes receiving the transmitter identifier from the remote computer; and further comprising determining the transmitter code based at least in part on the transmitter identifier.

9. The method of claim 1 wherein transmitting the second radio frequency control signal includes transmitting the transmitter code.

10. The method of claim 1 further comprising receiving first and second user inputs via a user interface; and wherein transmitting the first radio frequency control signal includes transmitting the first radio frequency control signal in response to the user interface receiving the first user input; and wherein transmitting the second radio frequency control signal includes transmitting the second radio frequency control signal in response to the user interface receiving the second user input.

11. The method of claim 1 further comprising presenting via a display of the in-vehicle apparatus a representation of the movable barrier operator system based at least in part on the information received from the remote computer.

12. A non-transitory computer readable medium having program instructions that, when executed by a processor of an in-vehicle apparatus, cause performance of operations comprising:

receiving information from a remote computer via a network, the information pertaining to one or more controllable devices including a movable barrier operator system associated with a user account;

receiving a user input requesting control of the movable barrier operator system;

communicating with the remote computer a transmitter identifier representative of a transmitter code of a transmitter of the in-vehicle apparatus;

transmitting a first radio frequency control signal to the movable barrier operator system to effect the movable barrier operator system to change a state of a movable barrier, the first radio frequency control signal including the transmitter code; and transmitting a second radio frequency control signal to the movable barrier operator system to effect the movable barrier operator system to learn the transmitter.

13. The non-transitory computer readable medium of claim 12 wherein transmitting the first radio frequency control signal includes transmitting the first radio frequency control signal at a first frequency, and wherein transmitting the second radio frequency control signal includes transmitting the second radio frequency control signal at a second frequency different than the first frequency.

14. The non-transitory computer readable medium of claim 13 wherein the first frequency is in the range of approximately 300 MHz to approximately 400 MHz; and wherein the second frequency is in the range of approximately 900 MHz to approximately 1 GHz.

15. The non-transitory computer readable medium of claim 12 wherein the operations further comprise, communicating a credential of the user account to the remote computer via the network.

16. The non-transitory computer readable medium of claim 15 wherein the operations further comprise receiving, via a user interface, the credential from a user.

17. The non-transitory computer readable medium of claim 12 wherein the transmitter code includes a fixed code of the transmitter; and wherein transmitting the second radio frequency control signal includes transmitting the fixed code and a changing code of the transmitter.

18. The non-transitory computer readable medium of claim 12 wherein communicating the transmitter identifier includes communicating a hash of the transmitter code with the remote computer.

19. The non-transitory computer readable medium of claim 12 wherein communicating with the remote computer includes receiving the transmitter identifier from the remote computer; and wherein the operations further comprise determining the transmitter code based at least in part on the transmitter identifier.

20. The non-transitory computer readable medium of claim 12 wherein transmitting the second radio frequency control signal includes transmitting the transmitter code.

21. The non-transitory computer readable medium of claim 12 wherein the operations further comprise receiving first and second user inputs; and wherein transmitting the first radio frequency control signal includes transmitting the first radio frequency control signal in response to receiving the first user input; and wherein transmitting the second radio frequency control signal includes transmitting the second radio frequency control signal in response to receiving the second user input.

22. The non-transitory computer readable medium of claim 12 wherein the operations further comprise presenting via a display of the in-vehicle apparatus a representation of the movable barrier operator system based at least in part on the information received from the remote computer.

23. A method of controlling a movable barrier operator system, the method comprising:

receiving, via communication circuitry of the movable barrier operator system, an add transmitter request from a remote computer via a network, the add transmitter request including a transmitter identifier;

receiving, via the communication circuitry, a first radio frequency control signal and a second radio frequency control signal from an unknown in-vehicle transmitter, the first radio frequency control signal including a transmitter code;

causing a motor of the movable barrier operator system to change a state of a movable barrier upon a determination that the transmitter code of the first radio frequency control signal corresponds to the transmitter identifier; and learning the unknown in-vehicle transmitter in response to the communication circuitry receiving the second radio frequency control signal.

24. The method of claim 23 wherein receiving the first radio frequency control signal and the second radio frequency control signal includes receiving the first radio frequency control signal at a first frequency, and receiving the second radio frequency control signal at a second frequency different than the first frequency.

25. The method of claim 24 wherein the first frequency is in the range of approximately 300 MHz to approximately 400 MHz; and wherein the second frequency is in the range of approximately 900 MHz to approximately 1 GHz.

26. The method of claim 23 wherein the transmitter code includes a fixed code of the unknown in-vehicle transmitter; and wherein learning the unknown in-vehicle transmitter includes storing the fixed code in a memory.

27. The method of claim 26 wherein receiving the second radio frequency control signal includes receiving a changing code; and wherein learning the unknown in-vehicle transmitter includes storing the changing code in the memory.

28. The method of claim 23 wherein the transmitter identifier includes a hash of the transmitter code, the method further comprising:

at a processor of the movable barrier operator system:

making the determination that the transmitter code of the first radio frequency control signal corresponds to the transmitter identifier includes performing a hash function on the transmitter code.

29. The method of claim 23 wherein learning the unknown in-vehicle transmitter includes learning the unknown in-vehicle transmitter in response to the second radio frequency control signal including the transmitter code.

30. The method of claim 23 wherein receiving the first and second radio frequency control signals includes receiving the first and second radio frequency control signals at different first and second frequencies; and wherein learning the unknown in-vehicle transmitter includes transmitting a radio frequency communication to the unknown in-vehicle transmitter at the second frequency as part of learning the unknown in-vehicle transmitter.

31. A server computer comprising:

a memory operable to store information pertaining to one or more controllable devices including a movable barrier operator system associated with a user account;

communication circuitry operable to communicate with an in-vehicle apparatus and the movable barrier operator system via a network; and a processor operably coupled to the communication circuitry and the memory, the processor configured to:

communicate to the in-vehicle apparatus, via the communication circuitry, the information pertaining to the one or more controllable devices;

communicate with the in-vehicle apparatus, via the communication circuitry, a transmitter identifier representative of a transmitter code of a transmitter of the in-vehicle apparatus; and communicate to the movable barrier operator system, via the communication circuitry, an add transmitter request including the transmitter identifier, the add transmitter request configured to facilitate determination by the movable barrier operator system, upon receipt by the movable barrier operator system of a first radio frequency control signal including the transmitter code from the transmitter of the in-vehicle apparatus, that the transmitter code corresponds to the transmitter identifier, and the add transmitter request further configured to facilitate learning of the transmitter of the in-vehicle apparatus by the movable barrier operator system upon receipt of a second radio frequency control signal from the in-vehicle apparatus.

32. The server computer of claim 31 wherein the processor is configured to communicate the information pertaining to the one or more controllable devices in response to receiving a credential of the user account from the in-vehicle apparatus via the network.

33. The server computer of claim 31 wherein the transmitter code includes a fixed code of the transmitter.

34. The server computer of claim 31 wherein the transmitter identifier includes a hash of the transmitter code; and wherein the processor is configured to cause the communication circuitry to communicate the hash of the transmitter code with the in-vehicle apparatus.

35. The server computer of claim 31 wherein the communication circuitry is configured to transmit the transmitter identifier to the in-vehicle apparatus via the network for the in-vehicle apparatus to determine the transmitter code based at least in part on the transmitter identifier.

36. The server computer of claim 31 wherein the communication circuitry is configured to receive the transmitter identifier from the in-vehicle apparatus via the network.

37. A non-transitory computer readable medium having program instructions that, when executed by a processor of a server computer, cause performance of operations comprising:

storing in a memory information pertaining to one or more controllable devices including a movable barrier operator system associated with a user account;

communicating to an in-vehicle apparatus the information pertaining to the one or more controllable devices;

communicating with the in-vehicle apparatus a transmitter identifier representative of a transmitter code of a transmitter of the in-vehicle apparatus; and communicating to the movable barrier operator system an add transmitter request including the transmitter identifier, the add transmitter request configured to facilitate determination by the movable barrier operator system, upon receipt by the movable barrier operator system of a first radio frequency control signal including the transmitter code from the transmitter of the in-vehicle apparatus, that the transmitter code corresponds to the transmitter identifier, and the add transmitter request further configured to facilitate learning of the transmitter of the in-vehicle apparatus by the movable barrier operator system upon receipt of a second radio frequency control signal from the in-vehicle apparatus.

* * * * *